US005649264A

United States Patent [19]

Domon et al.

[11] Patent Number: 5,649,264

[45] Date of Patent: Jul. 15, 1997

[54] DEVELOPING UNIT HAVING OPTICAL DETECTION OF A RESIDUAL QUANTITY OF DEVELOPER IN A DEVELOPER CONTAINER

[75] Inventors: Akira Domon, Kawasaki; Keiji Okano, Tokyo; Masahide Kinoshita, Yokohama; Yasushi Shimizu, Tokyo, all of Japan

[73] Assignee: Canon Kabushiki Kaisha, Tokyo, Japan

[21] Appl. No.: 340,413

[22] Filed: Nov. 15, 1994

[30] Foreign Application Priority Data

Nov. 18, 1993 [JP] Japan ..... 5-311073

[51] Int. Cl.[6] ..... G03G 15/08

[52] U.S. Cl. ..... 399/30; 399/27

[58] Field of Search ..... 355/245, 203, 355/208, 246, 260; 399/24, 27, 30

[56] References Cited

U.S. PATENT DOCUMENTS 5,035,198 7/1991 Nito .
5,036,358 7/1991 Yoshida .
5,045,886 9/1991 Weitzel et al. .
5,124,751 6/1992 Fukui et al. .
5,237,372 8/1993 Ishii et al. .
5,317,369 5/1994 Nakanishi .
5,398,106 3/1995 Eguchi .

*Primary Examiner*—Sandra L. Brase
*Attorney, Agent, or Firm*—Fitzpatrick, Cella, Harper & Scinto

[57] ABSTRACT

A developing unit including a developer container for accommodating a developer, a first window portion which is formed in an upper portion of the developer container and through which light passes, a second window portion which is formed in a lower portion of the developer container and through which light passes, a first wiping member for wiping the first window portion, a second wiping member for wiping the second window portion, and a holding member for holding the first wiping member and the second wiping member at opposite ends of said holding member, wherein the holding member performs a reciprocating operation with respect to a supporting point.

18 Claims, 30 Drawing Sheets

DEVELOPING UNIT HAVING OPTICAL DETECTION OF A RESIDUAL QUANTITY OF DEVELOPER IN A DEVELOPER CONTAINER

BACKGROUND OF THE INVENTION

1. Field of the Invention

The present invention relates to a developing unit that is used in an image forming apparatus, such as a copying machine, a printer or a facsimile machine, and more particularly to a developing unit which is capable of optically detecting the residual quantity of a developer in a container.

2. Description of the Related Art

Conventional image forming apparatuses employing an electrophotographic recording method, such as page printers and facsimile machines, usually comprise a unit for detecting the residual quantity of a developer in order to issue an alarm to a user prior to reduction in the developer in a developer container an amount that causes a thin and blurred image to be formed. The unit detects the residual quantity of the developer in the container by measuring any one of (1) the weight, (2) electrostatic capacity, (3) change in the torque of a stirring member, (4) the quantity of transmitted light or the like. The method (4) is widely employed because the apparatus can be constituted simply; the cost can be reduced; and the detection accuracy is relatively satisfactory. The foregoing method is characterized in that a light emitting device and a light receiving device are provided for the image forming apparatus body, and transparent windows through which light emitted by the light emitting device passes are formed in the developer container so that change in the output from the light receiving device occurring due to reduction in the developer in the developer container is used to detect the quantity of the residual developer. If the developer adheres to the surfaces of the transparent windows, light cannot sufficiently pass through the transparent windows, and therefore the detection accuracy deteriorates. Accordingly, a wiping member for removing the developer on the surfaces of the transparent windows is disposed in the developer container. In general, the wiping member is a flexible sheet member that is disposed together with a stirring member for stirring and conveying the developer in the developer container. The wiping member is rotated so as to be brought into contact with the surfaces of the transparent windows to remove the developer adhered to the surfaces of the transparent windows. Thus, the residual quantity of the developer can be detected stably and accurately.

In the foregoing case in which the wiping member is provided for the stirring member, the developer is forced to fly by the stirring member and the wiping member to thereby again adhere to the transparent windows.

Recently, there is a desire for reducing the size of the image forming apparatus, suck as a copying machine, a page printer, a facsimile apparatus or the like. Such a desire leads to a fact that the sizes of a developing unit and a process cartridge that are included in the foregoing apparatus must be reduced. Also the capacity of the developer container must be reduced. However, the conventional method has a critical problem when the quantity of the residual developer is detected in a light transmissive manner. In order to accurately detect the residual quantity, the transparent windows must be disposed adjacent to the developer carrier. Use of the conventional rotative wiping member causes the wiping member to be easily brought into contact with the developer carrier. Therefore, the transparent windows must be disposed away from the developer carrier and therefore the residual quantity cannot be detected accurately. In addition, further use of the developing unit or the process cartridge is inhibited though a large quantity of the developer is left in the developer container. Thus, an economical problem arises.

If the contact pressure of the wiping member with the transparent windows is inadequate, the force of the wiping member to slide on the surfaces of the transparent windows is weakened. Thus, the developer is left on the surfaces of the transparent windows and a predetermined output voltage cannot be obtained from received light. Therefore, there arises a problem in that an image thinner than a desired density is formed prior to issuing an alarm of a wanting state of the developer to a user. Specifically, the conventional developing unit comprises a flexible sheet serving as the wiping member and made of PET (Polyethylene Terephthalate) or urethane rubber that has a problem in that it is permanently deformed if it is left for a long time while being deformed. If the operation of the developing unit is completed in a state where the wiping member is in contact with the transparent windows or the developer container and the foregoing state is maintained for a long time, the wiping member is deformed permanently. Such deformation leads to a fact that the contact pressure of the wiping member with the transparent windows is lowered excessively and the transparent windows cannot be cleaned satisfactorily. Thus, a satisfactory quantity of light passing through the transparent windows cannot be obtained. The foregoing phenomenon becomes critical at high temperature and high humidity.

What is worse, a small size developing unit or process cartridge encounters a problem of the image quality because the torque may be enlarged or changed due to the presence of the wiping member.

SUMMARY OF THE INVENTION

An object of the present invention is to provide a developing unit in which transparent windows can be disposed adjacent to a developer carrier thereof.

Another object of the present invention is to provide a developing unit capable of preventing deformation of a wiping member thereof.

Another object of the present invention is to provide a developing unit capable of preventing erroneous detection of the quantity of residual developer.

According to one aspect of the present invention, the present invention relates to a developing unit comprising a developer container for accommodating a developer, a first window portion which is formed in an upper portion of said developer container and through which light passes, a second window portion which is formed in a lower portion of said developer container and through which light passes, a first wiping member for wiping said first window portion, a second wiping member for wiping said second window portion, and a holding member for holding said first wiping member and said second wiping member at opposite ends of said holding member, wherein said holding member performs a reciprocating operation with respect to a supporting point.

According to another aspect of the present invention, the present invention relates to a developing unit adapted for use with an image forming apparatus including an image carrier, said developing unit comprising a developer container for accommodating a developer, a developer carrier facing the image carrier and holding a developer in said developer container, first and second window portions which are formed in said developer container through which light is transmitted, a first wiping member for wiping said first window portion, a second wiping member for wiping said second window portion, and a holding member for holding said first wiping member and said second wiping member at opposite ends of said holding member, wherein a distance from a center of operation of said holding member to leading portions of said first and second wiping members is greater than a distance from the center of operation of said holding member to said developer carrier, and said holding member is configured so as to allow said first and second wiping members to perform reciprocating operations within a range in which said first and second wiping members are out of contact with said developer container.

According to yet another aspect of the present invention, the present invention relates to a developer unit comprising a developer container for accommodating a developer, a window portion which is formed in said developer container and through which light passes, and a wiping member that is moved at the time of performing of a developing operation to wipe said window portion, wherein said wiping member is positioned at a position at which said wiping member is out of contact with said window portion during non-developing operation.

According to still another aspect of the present invention, the present invention relates to a developing unit comprising a developer container for accommodating a developer, a window portion which is formed in said developer container and through which light passes, and a wiping member for wiping said window portion, wherein said window portion that is wiped by said wiping member has a concave surface.

Objects, features and advantages of the invention will be appear more fully from the following description.

DESCRIPTION OF THE PREFERRED EMBODIMENTS

Preferred embodiments of the present invention will now be described with reference to the drawings.

First Embodiment

A first embodiment of the present invention will now be described with reference to FIGS. 1 to 3.

A developing unit for use in this embodiment is formed integrally with at least an image carrier and formed into a process cartridge that can be attached/detached to and from the apparatus body.

Figure 1:
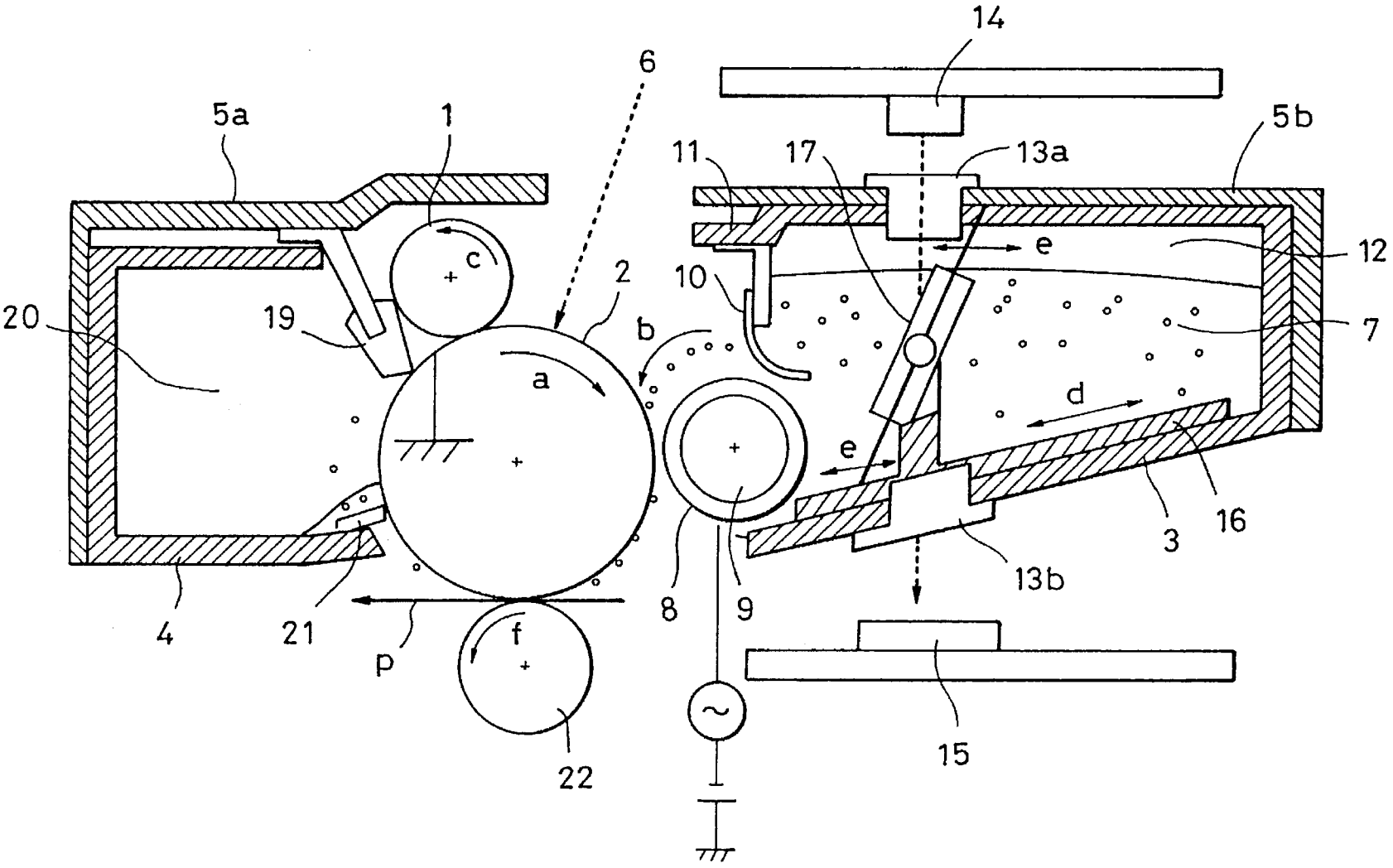
FIG. 1 is a cross sectional view which illustrates a process cartridge having a developing unit according to a first embodiment of the present invention.
Figure 2B:
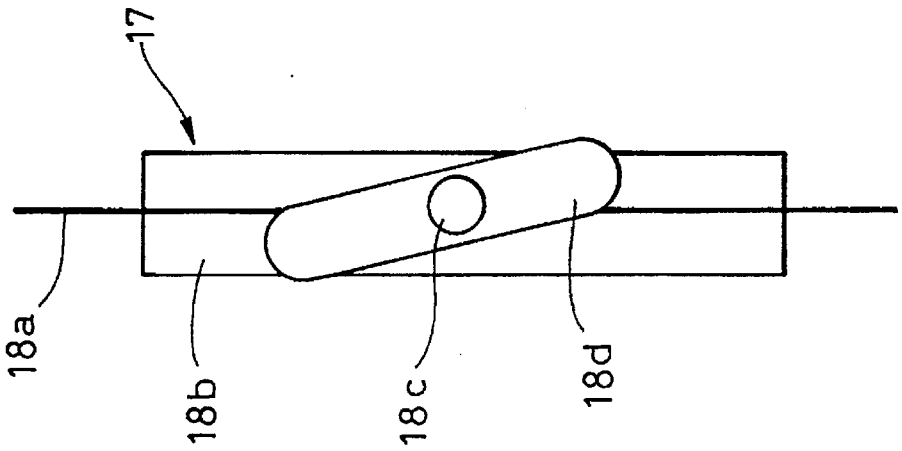
FIGS. 2A and 2B are a front view and a cross sectional view, respectively, which illustrate a wiping member according to a first embodiment of the present invention.
Figure 2A:
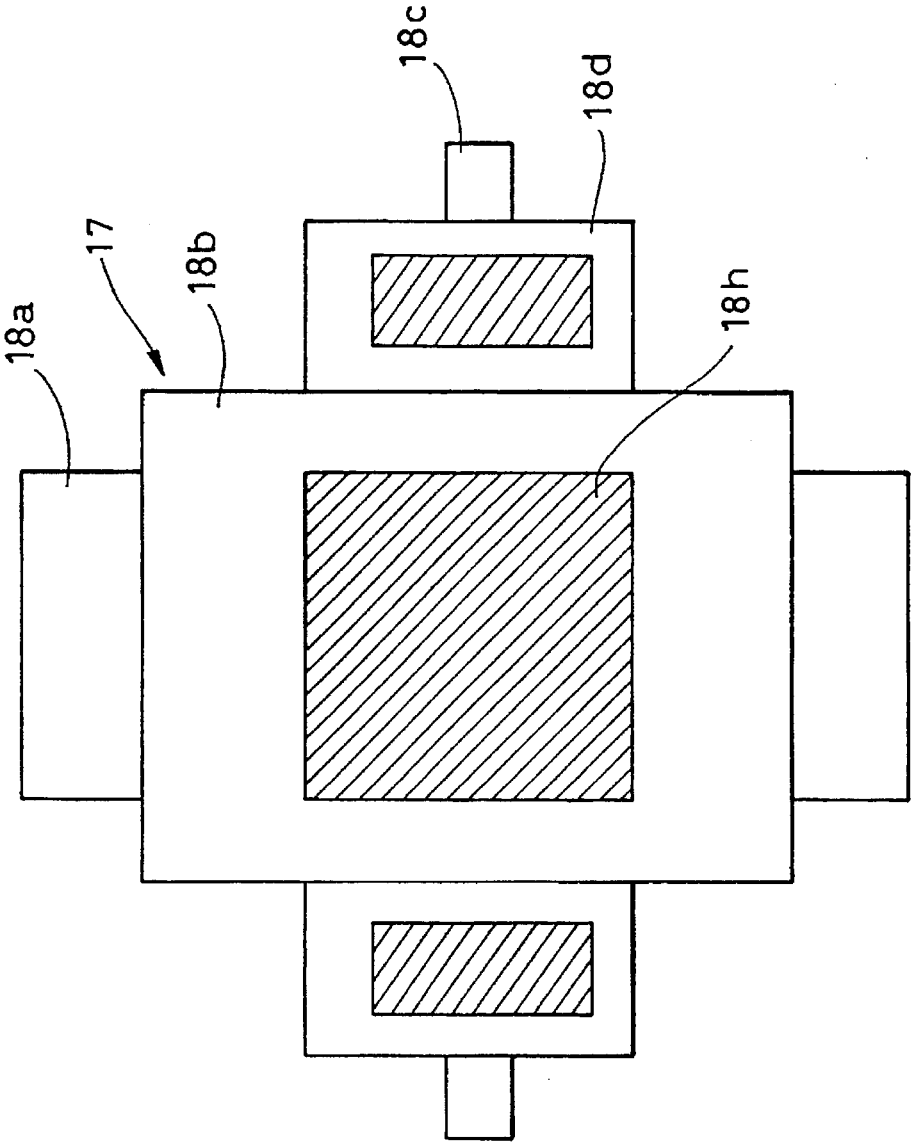
Figure 3:
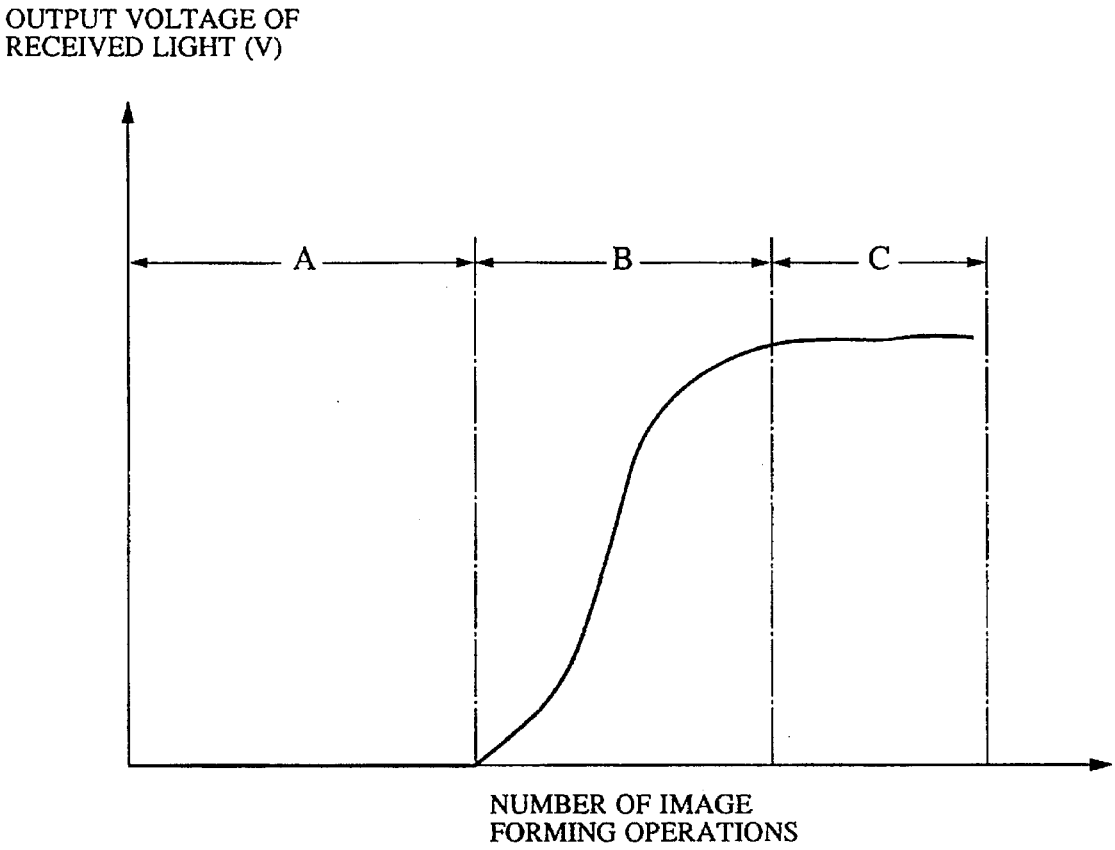
FIG. 3 is a graph showing the relationship between the number of times a light-transmissive apparatus for detecting the quantity of residual developer according to the first embodiment of the present invention forms images and the output voltage from received light.

FIG. 1 is a cross sectional view which illustrates the process cartridge for use in this embodiment, and FIGS. 2A and 2B are a front view and a vertical cross sectional view, respectively, which illustrate a wiping member.

The process cartridge according to this embodiment is formed into a compact body by enclosing, within housings 5*a* and 5*b*, a charging roller 1, a photosensitive drum which is a latent image carrier 2, a developing unit 3 and a cleaning unit 4. The process cartridge has an aperture between the charging roller 1 and the developing unit 3, the aperture being used to expose the image to light by the latent image carrier 2 and an exposing means 6.

The charging roller 1 is in contact with the latent image carrier 2 and follows the latent image carrier 2 that is rotated in a direction designated by an arrow a so that the charging roller 1 is rotated in a direction designated by an arrow c. Thus, the charging roller 1 uniformly charges the surface of the latent image carrier 2 when applied with AC voltage.

The latent image carrier 2 is applied with a photosensitive material and is rotated in the direction designated by the arrow a by a drive system (not shown) included in the image forming apparatus body so that the surface of the latent image carrier 2 is charged by the charging roller 1. Then, the latent image carrier 2 is exposed to light by the exposure means 6 so that a latent image is formed on the surface of the latent image carrier 2.

The developing unit 3 comprises: a developer 7 having a magnetic toner that causes the electrostatic latent image formed on the latent image carrier 2 to be a visible image; a hollow and cylindrical developer carrier 8 that is rotated in the direction designated by the arrow b, disposed at a predetermined interval from the latent image carrier 2, and rotated in the direction designated by the arrow b to carry the developer 7; a cylindrical magnet roller 9 the two ends of which are secured in the developer carrier 8, and which is not rotated but which is fixed and which includes a plurality of magnetic poles; an elastic rubber blade 10 serving as a developer restricting member which is in contact with the developer carrier 8 to restrict the coating thickness of the developer 7 on the developer carrier 8; a metal member 11 for supporting the elastic rubber blade 10; and a developer accommodating chamber 12 for accommodating the developer 7. A toner image caused to be a visible image on the surface of the latent image carrier 2 is, by a transfer roller 22, which is rotated in a direction designated by an arrow f, transferred to a transfer member P. Then, the transferred image is, by heat or pressure of a fixing unit (not shown), fixed to the surface of the transfer member P before it is discharged outside of the image forming apparatus.

The developer accommodating chamber 12 has a bottom surface and a surface opposing the bottom surface respectively having transparent windows 13*a* and 13*b* attached thereto. Furthermore, a light emitting device 14 and a light receiving device 15 are disposed at positions opposing the transparent windows 13*a* and 13*b*. The developer accommodating chamber 12 has a stirring member 16 that is driven by a drive system of the image forming apparatus body (not shown) through a drive gear of the latent image carrier 2 so as to perform reciprocating motion in a direction designated by an arrow d. Thus, the stirring member 16 moves the developer 7 to the developer carrier 8. A wiping member 17 for wiping the developer 7 adhered to the transparent windows 13*a* and 13*b*, as shown in FIGS. 2A and 2B, comprises: a flexible sheet member 18*a* made of polyethylene terephthalate (PET) or the like; and a holding member 18*b*. The holding member 18*b* has a rotational shaft 18*c* and a swing shaft 18*d* that is driven by the stirring member 16. As a result of linkage of swing shaft 18*d* with the stirring member 16, holding member 18*b* rotates about rotational shaft 18*c*, and thereby the top and bottom ends of the wiping member 17 perform a reciprocating motion in a direction designated by an arrow e (as illustrated in FIG. 1) to draw an arc (not shown). Thus, the wiping member 17 slides on the surfaces of the transparent windows 13*a* and 13*b* so as to remove the developer 7. Note that the hatched sections shown in FIG. 2 are opened, e.g., central hole 18*h*.

The cleaning unit 4 comprises: a cleaning blade 19 for wiping the developer 7 left on the surface of the latent image carrier 2; a waste developer accommodating chamber 20 for accommodating the wiped developer 7 (hereinafter called "waste developer"); and a squeezing sheet 21 for preventing leakage of the waste developer to the outside of the process cartridge.

A method of detecting the quantity of the residual developer according to this embodiment will now be described. In the method according to this embodiment, light emitted from the light emitting device 14, for example, an LED, is allowed to pass through the two transparent windows 13*a* and 13*b* of the developer accommodating chamber 12. Then, light reaches the light receiving device 15 so that light is converted into output voltage. The output voltage has a correlative relationship as shown in FIG. 3 with the quantity of the developer in the developer accommodating chamber 12 and the number of image forming times. The quantity of the developer in the developer accommodating chamber 12 is reduced whenever an image is formed. The wiping member 17 cannot be operated as designed if the developer 7 is sufficiently left in the developer accommodating chamber 12 because the developer 7 has a large resistance. That is, the wiping member 17 is allowed to perform a reciprocating motion for a distance which is shorter than the maximum amplitude of the leading portion of the flexible sheet member 18*a* because the wiping member 17 is linked to the stirring member 16. At this time, the output voltage is 0 V ("A" as shown in FIG. 3). After images have been formed repeatedly, the developer 7 in the developer accommodating chamber 12 is reduced, causing the resistance acting on the wiping member 17 to be reduced gradually. As a result, the wiping member 17 performs a reciprocating motion for the maximum amplitude at the leading portion of the flexible sheet member 18*a*. Although the transparent window 13*b*, which is a lower window, is immersed in the developer 7, the sliding operation of the flexible sheet member 18*a* on the transparent window 13*b* removes the developer on the transparent window 13*b*. As a result, the output voltage is gradually raised ("B" as shown in FIG. 3). If image forming operations are further performed, the developer 7 is reduced and the surface of the lower transparent window 13*b* immersed in the developer 7 appears. The sliding operation of the flexible sheet member 18*a* removes the developer 7 on the transparent windows 13*a* and 13*b*. Thus, light emitted from the light emitting device 14 provided for the image forming apparatus body is not shielded by the developer 7; instead, the light, but it, in a sufficiently quantity, reaches the light receiving device 15 provided for the image forming apparatus. Thus, the highest output voltage can be obtained ("C" in FIG. 3). The structure is arranged in such a manner that a developer empty alarm is displayed on an operation panel of the image forming apparatus when the output voltage is raised to a certain level.

With the foregoing detection method, the quantity of the developer left in the developer accommodating chamber 12 at the time of issuing the developer empty alarm can be reduced and an economical structure can be constituted by shortening the distance from the transparent windows 13*a* and 13*b* to the developer carrier 8. If the distance from the center of the operation of the wiping member to the leading portion of the wiping member is longer than the shortest distance from the wiping member to the developer carrier, the conventional structure using the rotative wiping member undesirably causes the leading portion of the flexible sheet member 18*a* to interfere with the developer carrier, if the transparent windows are formed adjacent to the developer carrier. In this case, the coating state of the developer on the developer carrier is disordered and a problem of quality of the formed image occurs.

Accordingly, this embodiment has the arrangement such that: the stirring member 16 is caused to perform the reciprocating operation to carry the developer 7 to the developer carrier 8; the wiping member 17 for removing the developer 7 on the surface of the transparent windows 13*a* and 13*b* is linked with the stirring member 16 to perform the reciprocating operation. Thus, the transparent windows 13*a* and 13*b* can be made to be nearer to the developer carrier 8 as compared with the conventional unit for detecting the residual quantity of the developer having the rotative stirring member and the wiping member. Since the wiping member 17 has the open portion 18*h* at the center thereof, the load from the developer 7 can be reduced and undesirable enlargement of the torque occurring due to the provision of the wiping member 17 can be prevented.

As a result, this embodiment enables a precise and economical unit for detecting the quantity of the residual developer, and provides having a simple structure therefor.

Second Embodiment

A second embodiment of the present invention will now be described with reference to FIGS. 4 to 8. The second embodiment is different from the first embodiment with respect to the wiping member and the holding member that is operated together with the wiping member. The other structures are the same as those of the first embodiment and descriptions of the same elements are omitted hereinbelow.

A light transmissible unit for detecting the quantity of the residual developer must have the wiping member 17 for removing the developer 7 adhered to the surfaces of the transparent windows 13*a* and 13*b*. The wiping member 17 is linked with the stirring member 16, that is driven by the drive system of the image forming apparatus body through the drive gear of the latent image carrier 2, so that the wiping member 17 slides on the transparent windows 13*a* and 13*b*. Thus, the presence of the wiping member 17 undesirably enlarges the torque required to rotate the latent image carrier 2. The foregoing torque is changed by the contact pressure of the flexible sheet member 18*a* with the transparent windows 13*a* and 13*b*. The contact pressure is changed by the free length determined by the thickness of the flexible sheet member 18*a*, the degree of introduction into the transparent windows 13*a* and 13*b* and the positional relationship between the transparent windows 13*a* and 13*b* and the holding member 18*b*. In this embodiment, the free length is defined as the shortest distance from the leading portion of the holding member 18*b* to the transparent window that faces the holding member 18*b*. Further, the degree of introduction, or introduction quantity, of flexible sheet member 18*a*, refers to the difference between the amount by which flexible sheet member 18*a* extends from holding member 18*b*, and the shortest distance from the leading portion of holding member 18*b* to the transparent window that faces holding member 18*b*. In order to reduce the torque, the contact pressure of the flexible sheet member 18*a* with the transparent windows 13*a* and 13*b* must be lowered by using a further thin flexible sheet member 18*a* to lengthen the free length to reduce the degree of introduction. However, the contact of the flexible sheet member 18*a* with the transparent windows 13*a* and 13*b* is weakened, thus raising difficulty in removing the developer 7 adhered to the surfaces of the transparent windows 13*a* and 13*b*. Such a difficulty leads to a fact that a satisfactory output voltage cannot be obtained from received light. That is, the reduction in the torque and the obtaining of a satisfactory wiping force of the flexible sheet member 18*a* are contrary factors. On the other hand, this embodiment is able to lower the contact pressure of the flexible sheet member 18*a* with the transparent windows 13*a* and 13*b* to reduce the torque by removing the developer 7 on the surfaces of the transparent windows 13*a* and 13*b* to maintain a satisfactory output voltage obtained from received light.

This embodiment will now be described further in detail with reference to FIG. 4. A comparative example is shown in FIG. 5. An assumption is made that the introduction degrees $\delta_1$, $\delta_2$, $\delta'_1$ and $\delta'_2$ of the flexible sheet member 18*a* into the transparent windows 13*a* and 13*b* are the same. The thicknesses of the upper and lower flexible sheet members 18*a* are the same.

Figure 4:
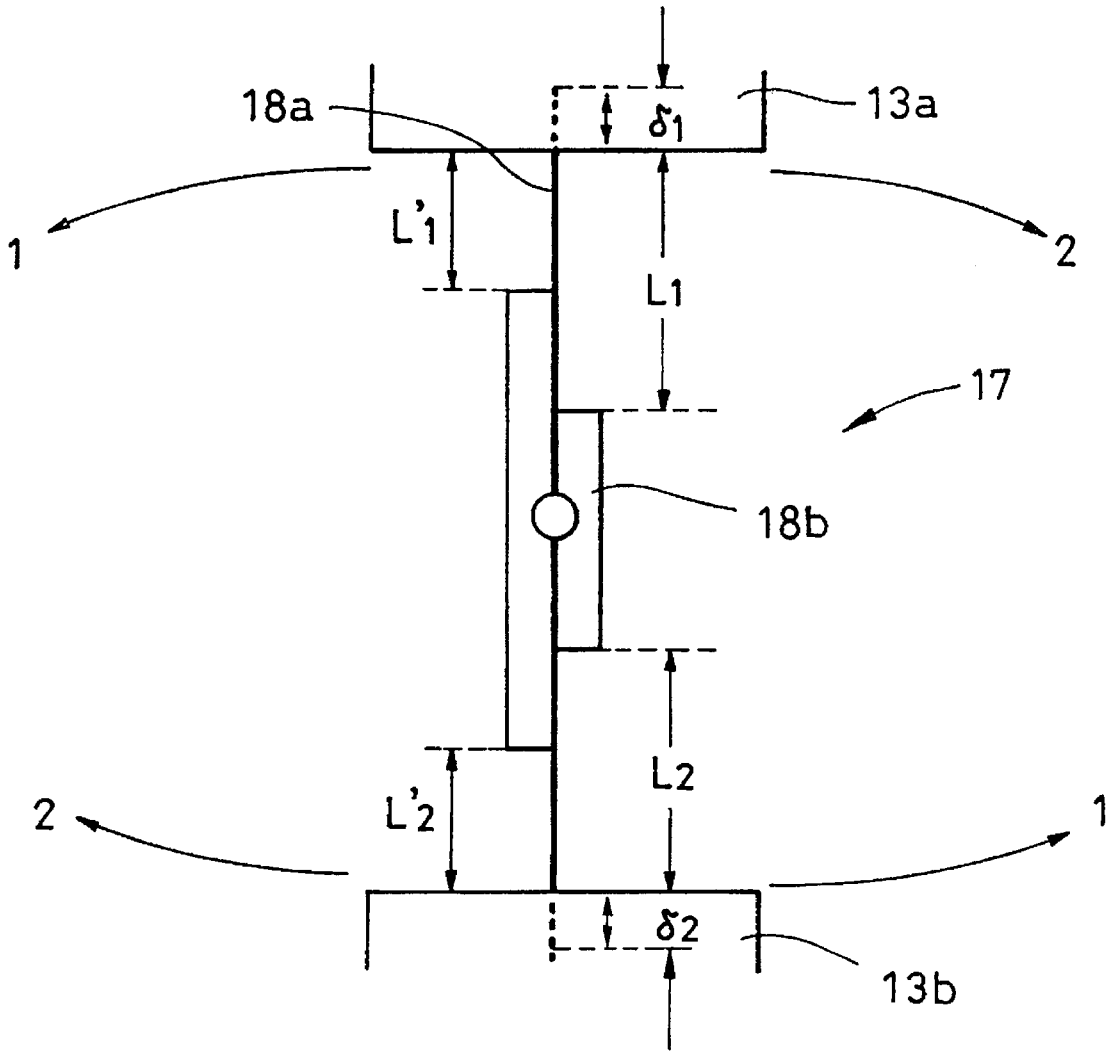
FIG. 4 is a cross sectional view which illustrates the positional relationship between the wiping member and the transparent windows according to a second embodiment of the present invention.
Figure 5:
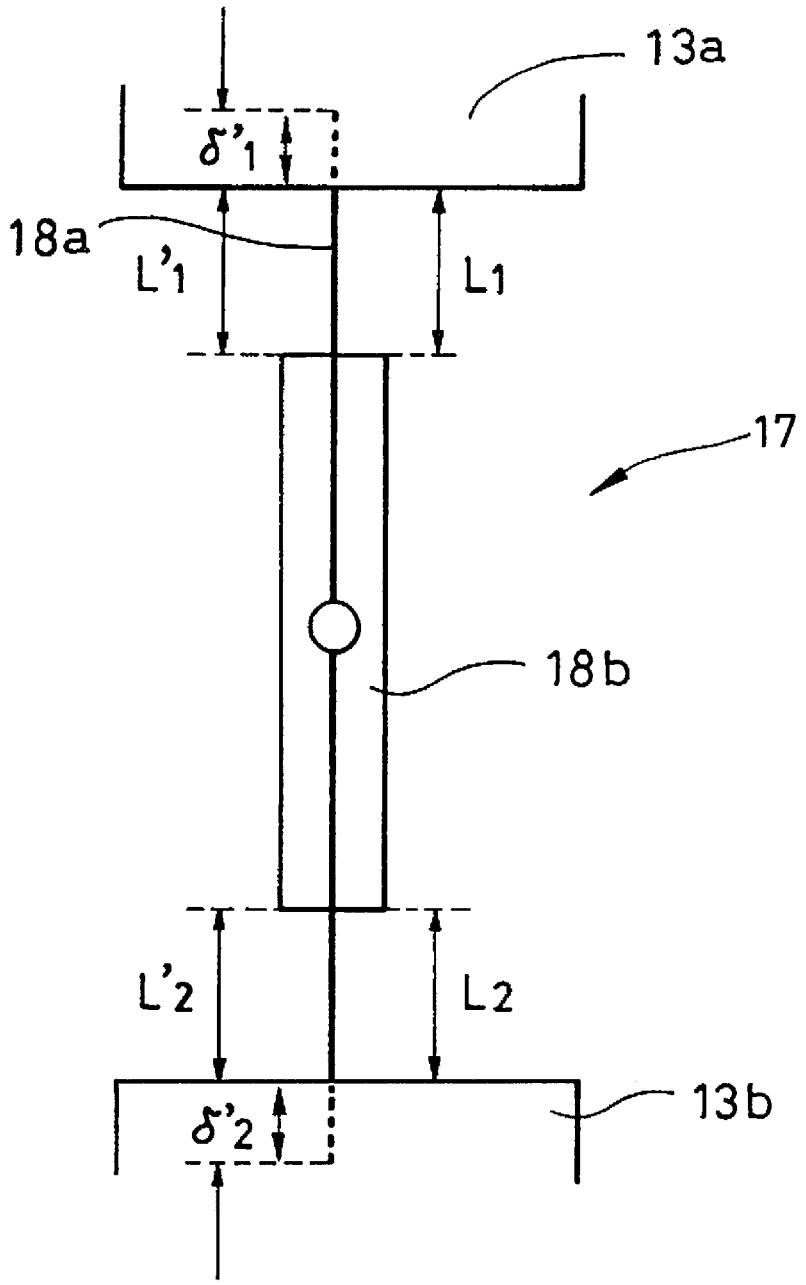
FIG. 5 is diagram which illustrates a comparative example of the second embodiment of the present invention.
Figure 6:
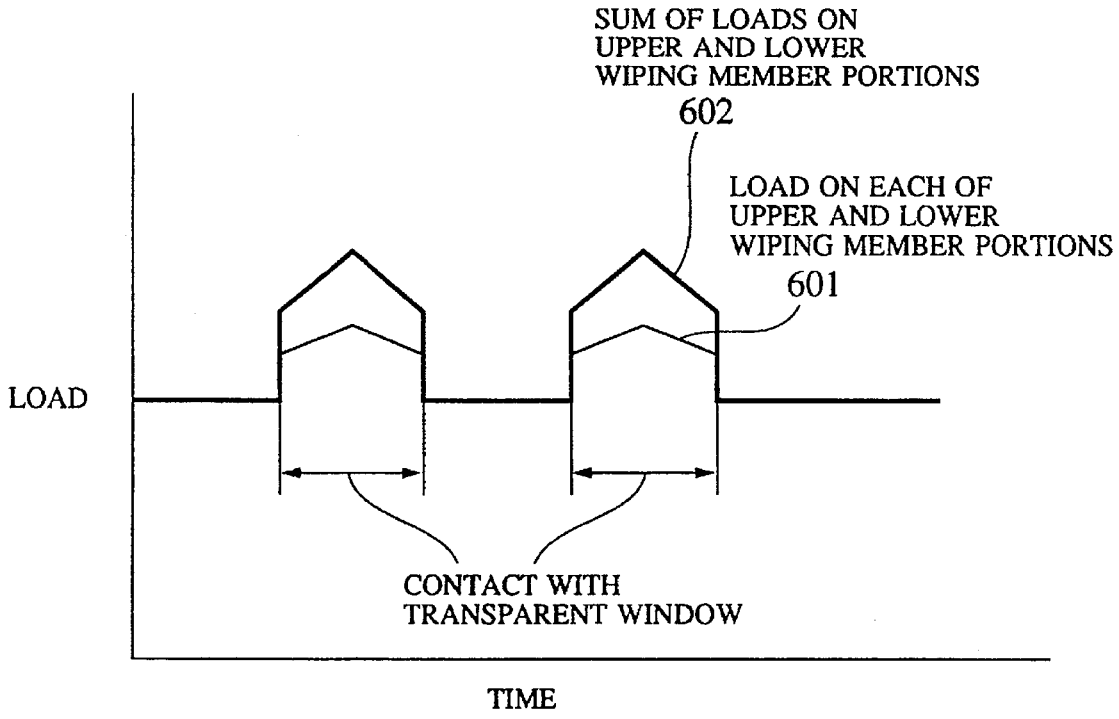
FIG. 6 is a graph showing a state of load of the wiping member according to the comparative example of the second embodiment of the present invention.
Figure 7:
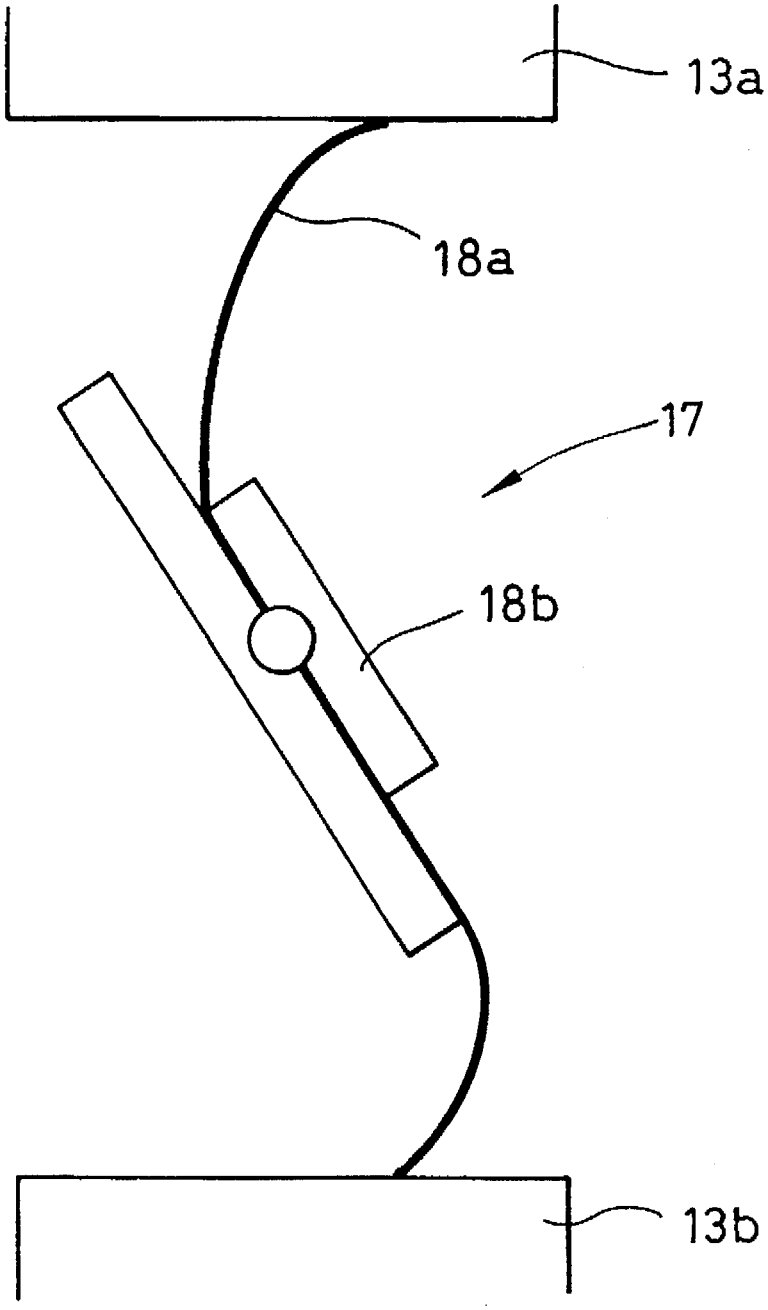
FIG. 7 is a cross sectional view which illustrates the positional relationship between the wiping member and the transparent windows according to the second embodiment of the present invention in a state where the apparatus is being operated.
Figure 8:
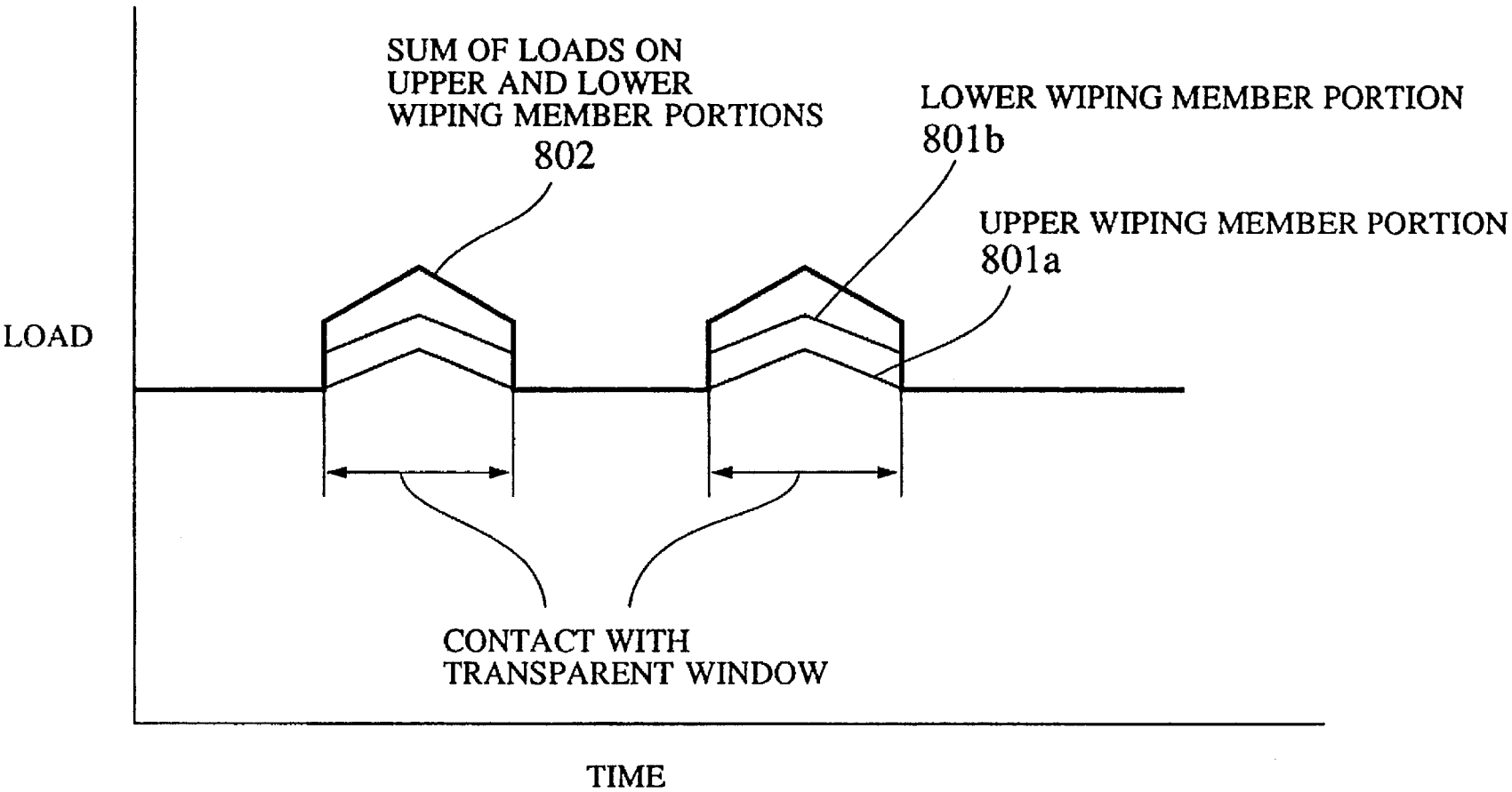
FIG. 8 is a graph showing a state of load of the wiping member according to the second embodiment of the present invention.

An important portion of this embodiment lies in that the four lengths $L_1$, $L'_1$, $L_2$ and $L'_2$ of the holding member 18*b* for holding the flexible sheet member 18*a* shown in FIG. 4 hold the relationships $L_1>L'_1$ and $L_2>L'_2$. In a case shown in FIG. 5 where $L_1=L'_1=L_2=L'_2$, the load acting on the upper and lower portion of wiping member 17 is changed as shown in FIG. 6. In the foregoing case (FIGS. 5 and 6), similar loads act on each of the upper and lower portions of wiping member 17, as depicted by line 601 in FIG. 6. Line 602 in FIG. 4 schematically illustrates the sum of the loads on the upper and lower portions of wiping member 17. By causing $L_1>L'_1$ and $L_2>L'_2$ as shown in FIG. 4, for example, $L_1=8$ mm, $L'_1=6$ mm, $L_2=8$ mm and $L'_2=6$ mm, a state shown in FIG. 7 is realized when the wiping member 17 is moved in a direction designated by an arrow 1 shown in FIG. 4. Thus, the load is changed as shown in FIG. 8 so that the total sum of the torques acting on the upper and lower portions of the wiping member 17 (schematically illustrated as load line 802 in FIG. 8) can be reduced as compared with the case shown in FIG. 6. The reason for this is that the apparent free length of the upper portion of the wiping member 17 is lengthened and the load acting on the upper wiping member 17 is reduced (schematically illustrated as load line 801 in FIG. 8), namely, the contact pressure of the upper flexible sheet member 18*a* with the transparent window 13*a* is lowered. As a result, the torque can be reduced (load line 801*b* in FIG. 8 schematically illustrates the load in the lower portion or wiping member 17). At this time, the developer 7 on the surface of the lower transparent window 13*b* can be removed satisfactorily. The foregoing effects can be applied to a case where the wiping member 17 is moved in a direction designated by an arrow 2 shown in FIG. 4. In this case, the apparent free length of the lower portion of the wiping member 17 is lengthened and the load acting on the lower portion of the wiping member 17 is therefore reduced. As a result, the torque can be reduced. At this time, the developer 7 on the surface of the upper transparent window 13*a* can be removed sufficiently. By repeating the foregoing operations, a sufficient output voltage obtained from received light can be obtained. Furthermore, excessive contact by the wiping member 17 can be prevented. Thus, damage of the transparent windows 13*a* and 13*b* and fusion of the developer 7 can be prevented. Therefore, a stable quantity of transmitted light can be obtained.

As described above, this embodiment is able to prevent enlargement of the torque occurring due to the provision of the wiping member 17, while completely removing the developer 7 on the surfaces of the transparent windows 13*a* and 13*b* and obtaining a satisfactory high output voltage from received light.

Third Embodiment

Figure 9:
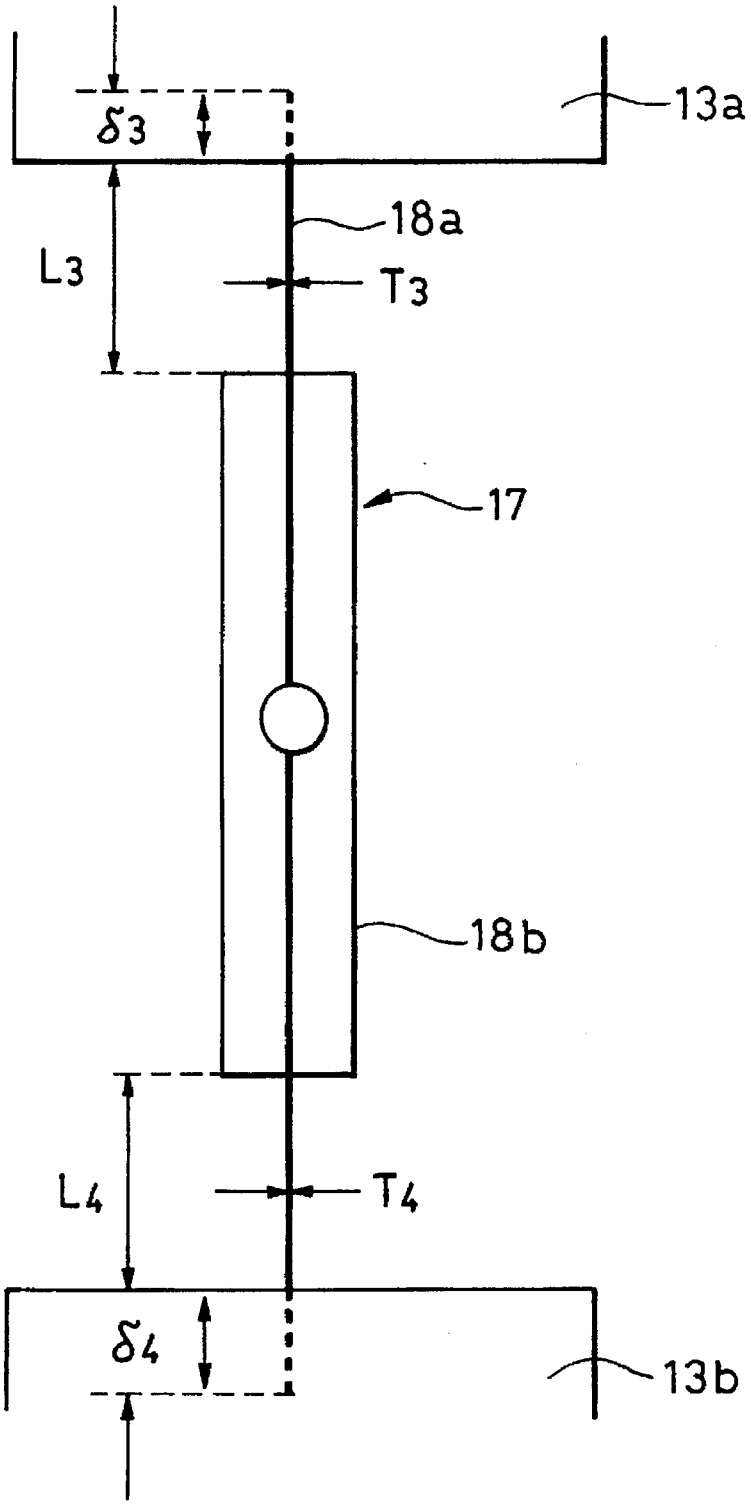
FIG. 9 is a cross sectional view which illustrates the positional relationship between the wiping member and the transparent windows according to a third embodiment of the present invention.
Figure 10:
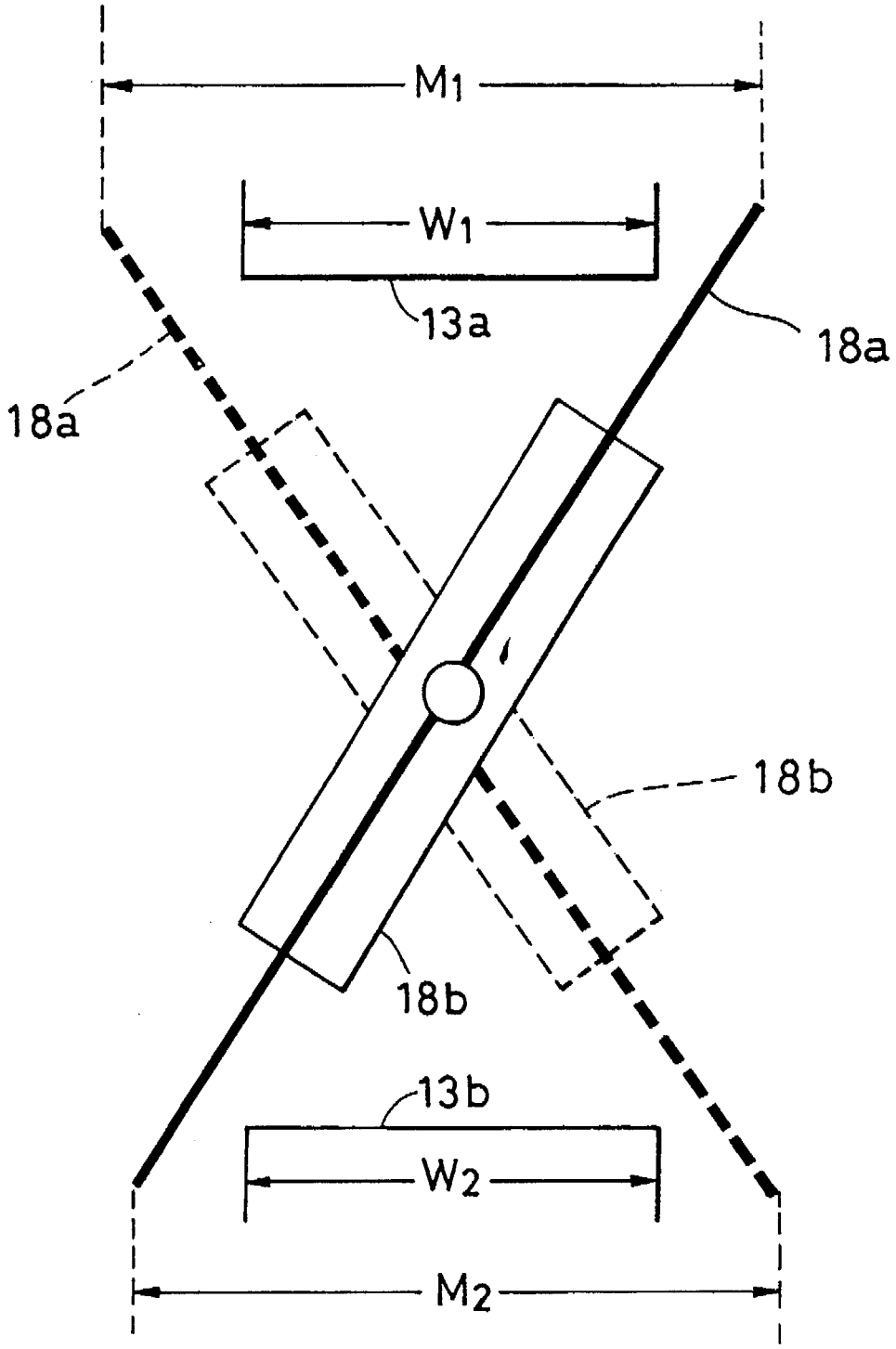
FIG. 10 is a cross sectional view which illustrates the positional relationship between the wiping member and the transparent windows according to a comparative example of a fourth embodiment of the present invention.

A third embodiment of the present invention will now be described with reference to FIG. 9. The third embodiment is different from the first embodiment with respect to the wiping member. The other structures are the same as those of the first embodiment and therefore the same elements as those according to the first embodiment are omitted from description.

A light transmissive unit for detecting the quantity of the residual developer must have the wiping member 17 to remove the developer 7 adhered to the surfaces of the transparent windows 13*a* and 13*b*. However, the problem arises in that the torque is enlarged due to the presence of the wiping member 17 as described in the second embodiment. This third embodiment is intended to reduce the torque by removing the developer 7 on the surfaces of the transparent windows 13*a* and 13*b* while maintaining a sufficiently high output voltage obtained from received light.

The lower transparent window 13 is immersed in the developer 7 for a long time as compared with the upper transparent window 13*a*, and it is brought into contact with the flexible sheet member 18*a* in the immersed state. Therefore, the developer easily adheres to the lower transparent window 13*b*. Since the upper transparent window 13*a* is not immersed in the developer 7, the developer 7 is adhered only when it is raised by the wiping member 17. Therefore, the force required to remove the developer 7 on the surfaces of the transparent windows 13*a* and 13*b*, that is, the contact pressure of the flexible sheet member 18*a* with the transparent windows 13*a* and 13*b* must be reduced with respect to the upper transparent window 13*a* and the same must be enlarged with respect to the lower transparent window 13*b*. The forces to remove the developer 7 on the surfaces of the transparent windows 13*a* and 13*b* is, as described above, changed by the free length determined by the thickness of the flexible sheet member 18*a*, the degree of introduction into the transparent windows 13*a* and 13*b* and the positional relationship between the transparent windows 13*a* and 13*b* and the holding member 18*b*. In a case where the degrees of introduction of the upper and lower flexible sheet members 18*a* into the transparent windows 13*a* and 13*b* are the same, excessively large force is applied to the upper flexible sheet member 18*a*. Thus, the torque cannot be reduced. In this embodiment, in the case where the thicknesses $T_3$ and $T_4$ of the upper and lower flexible sheet members 18*a* are the same and where $L_3=L_4$, then the introduction quantity $\delta_3$ into the upper transparent window 13*a* and the introduction quantity $\delta_4$ into the lower transparent window 13*b* are determined to be $\delta_3<\delta_4$, for example, $\delta_3=1.8$ mm, $\delta_4=2.8$ mm. Thus, the load acting on the upper portion of the wiping member 17 can be reduced and thus the enlargement of the torque can be prevented. In a case where $T_3=T_4$ and $\delta_3=\delta_4$, the relationship $L_3>L_4$ is held, for example, $L_3=6.8$ mm and $L_4=5.8$ mm. Thus, a similar effect can be obtained. In a case where $L_3=L_4$ and $\delta_3=\delta_4$, the relationship $T_3<T_4$ is held, for example, $T_3=50$ μm, and $T_4=75$ μm. A similar effect can be obtained. Furthermore, excessive contact of the wiping member 17 can be prevented, and therefore the surfaces of the transparent windows 13*a* and 13*b* can be protected from damage, and adhesion of the molten developer 7 can be prevented. As a result, a stable quantity of transmitted light can be obtained.

As described above, this embodiment enables the developer 7 on the surfaces of the transparent windows 13*a* and 13*b* to be removed completely, and thus the enlargement of the torque caused from the load of the wiping member 17 can be prevented while maintaining sufficiently high output voltage from received light.

Fourth Embodiment

A fourth embodiment of the present invention will now be described with reference to FIGS. 10 to 14. This embodiment is different from the first and third embodiments with respect to the cross sectional shape of the transparent window. The other structures are the same as the first embodiment and therefore the descriptions of the same elements are omitted.

Figure 11:
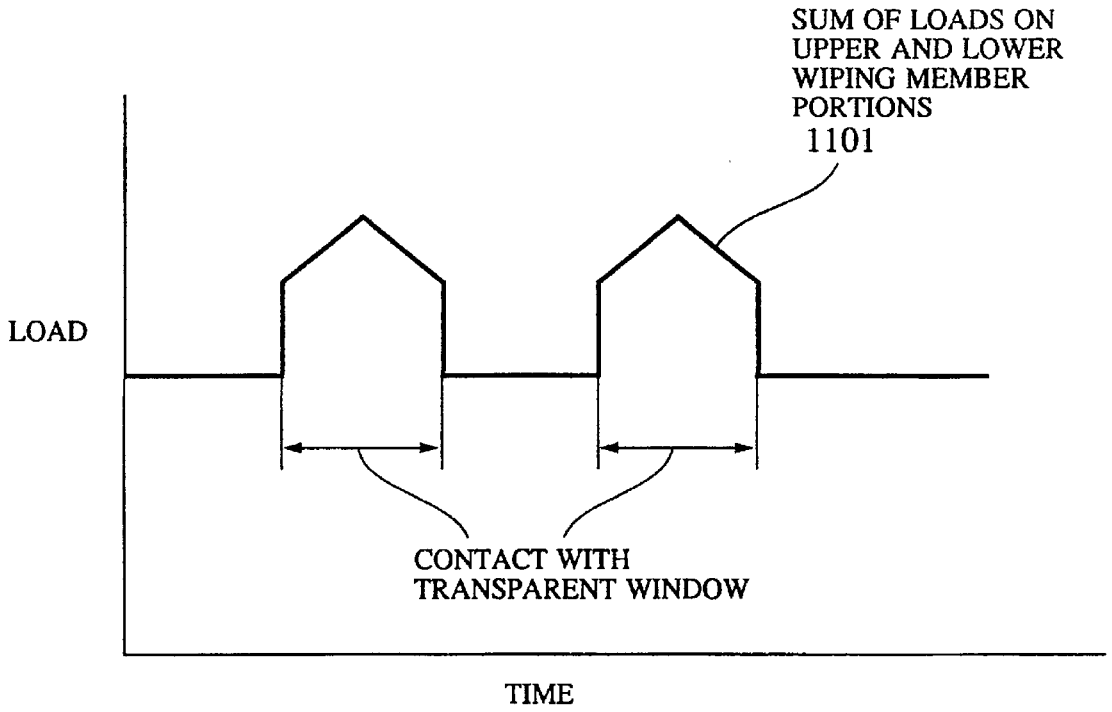
FIG. 11 is a graph showing a state of load of the wiping member according to the comparative example of the fourth embodiment of the present invention.

In a case where the wiping member 17 that performs the reciprocating operation is used, if the maximum amplitudes $M_1$ and $M_2$ of the leading portion of the flexible sheet member 18*a* are larger than the window widths $W_1$ and $W_2$ in the direction in which the wiping member 17 is moved (FIG. 10), that is, if $M_1>W_1$ and $M_2>W_2$, for example, $M_1=M_2=20$ mm and $W_1=W_2=10$ mm, two states are present: one state in which the flexible sheet member 18*a* is not in contact with the transparent windows 13*a* and 13*b*, and another state in which the same are in contact. If the cross sectional shape of each of the transparent windows 13*a* and 13*b*, when viewed from a direction perpendicular to the direction in which the wiping member 17 is moved is rectangular or square, then the quantity of introduction of the flexible sheet member 18*a* into the transparent windows 13*a* and 13*b* is rapidly enlarged when the flexible sheet member 18*a* is brought into contact with the transparent windows 13*a* and 13*b*. Therefore, the load acting on the wiping member 17 is excessively changed as shown in FIG. 11. In FIG. 11, load line 1101 schematically depicts the sum of the loads on the upper and lower portions of wiping member 17. In this embodiment, the wiping member 17 is operated in synchronization with the stirring member 16 which is driven by the drive system of the image forming apparatus body. Therefore, the foregoing load change is undesirably transmitted to the drive system whenever the flexible sheet member 18*a* is introduced into the transparent windows 13*a* and 13*b*.

Figure 12:
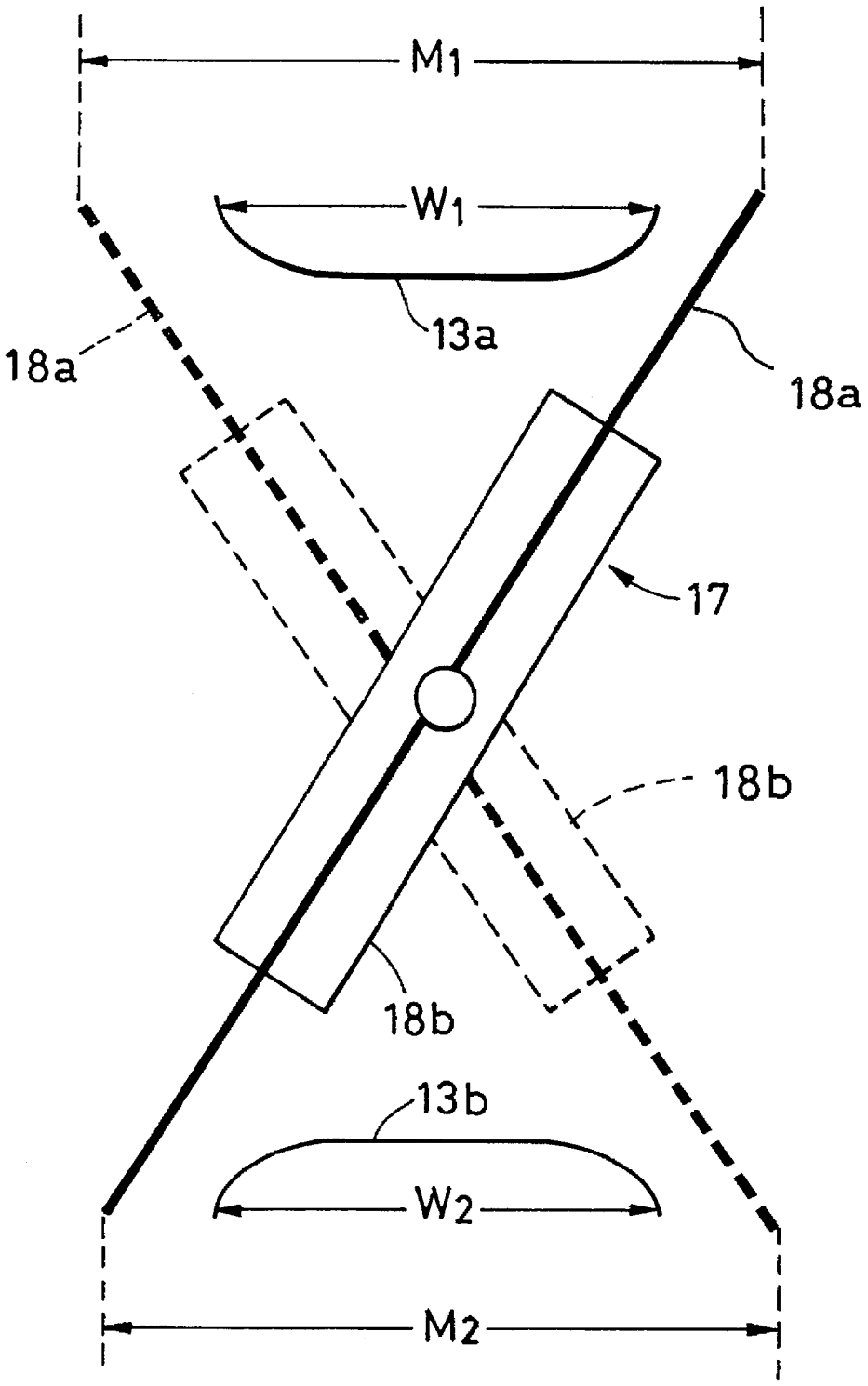
FIG. 12 is a cross sectional view which illustrates the positional relationship between the wiping member and the transparent windows according to the fourth embodiment of the present invention.
Figure 13:
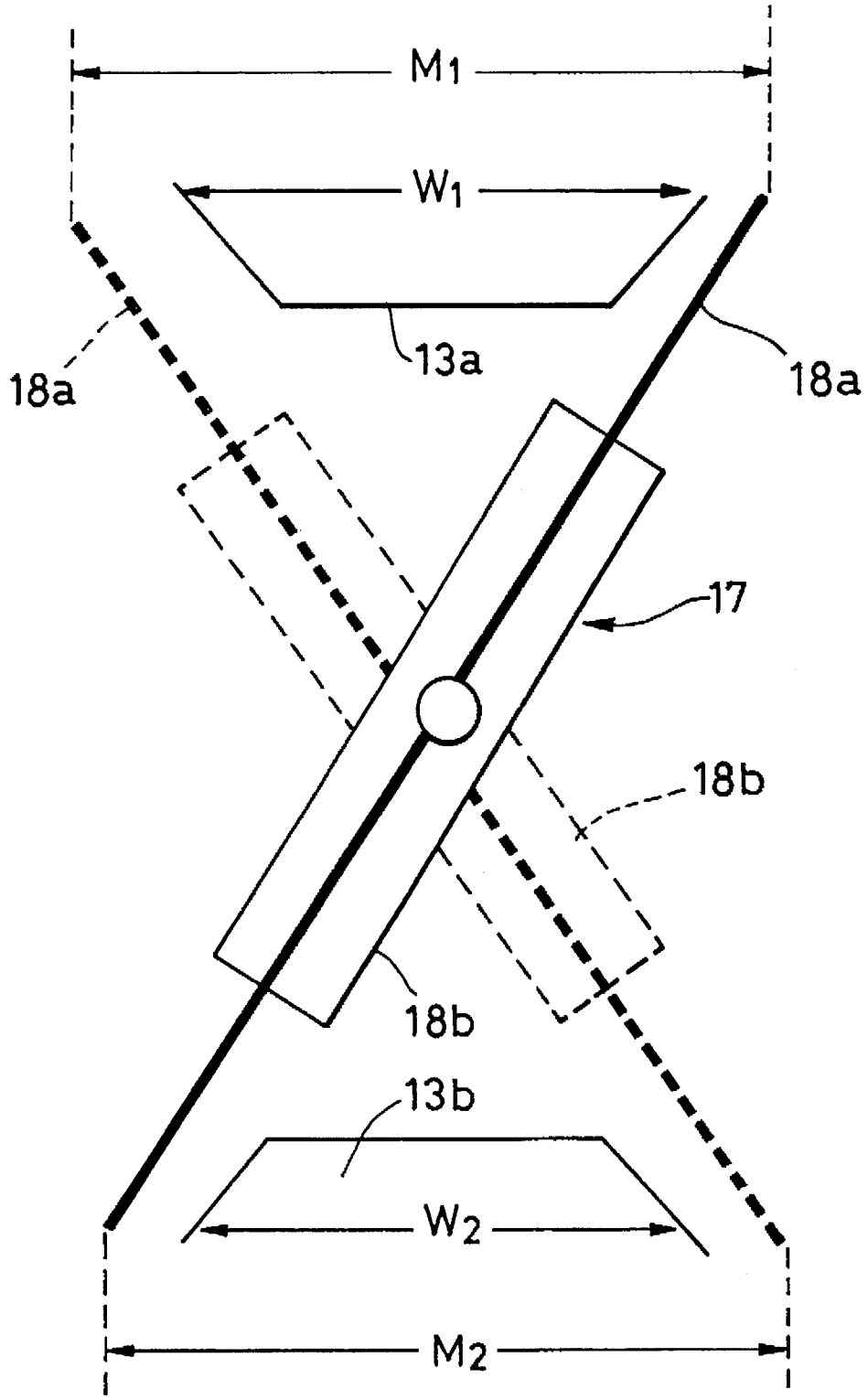
FIG. 13 is a cross sectional view which illustrates the positional relationship between the wiping member and the transparent windows according to the fourth embodiment of the present invention.
Figure 14:
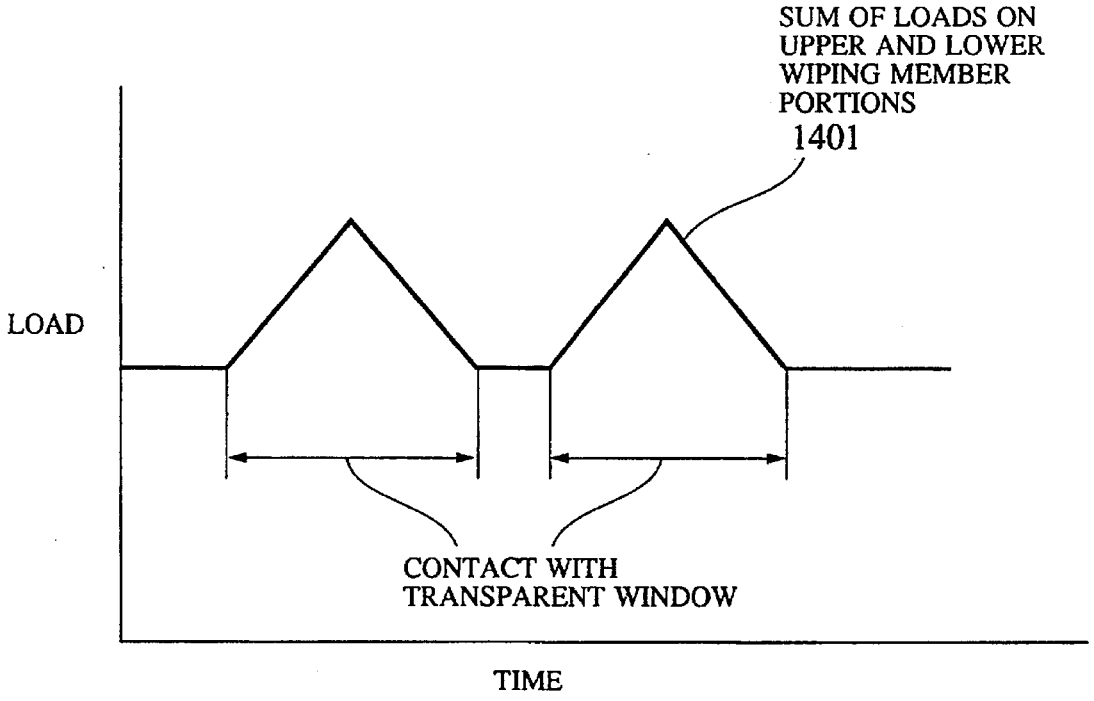
FIG. 14 is a graph showing a state of load of the wiping member according to the fourth embodiment of the present invention.

Accordingly, this embodiment has a structure wherein the cross sectional shape of each of the transparent windows 13*a* and 13*b*, when viewed in the direction in which the wiping member 17 is moved, is formed as shown in FIG. 12 such that each of the portions of the transparent windows 13*a* and 13*b* into which the flexible sheet member 18*a* is introduced has a curvature. As an alternative to this, inclined portions of the transparent windows 13*a* and 13*b* may be provided as shown in FIG. 13. As a result, the quantity of introduction of the flexible sheet member 18*a* into the transparent windows 13*a* and 13*b* is not rapidly changed but the same is gradually increased, thereby causing the load to be gradually enlarged (as shown by load line 1401 in FIG. 14, which schematically illustrates the sum of the loads on the upper and lower portions of wiping member 17). Thus, the rapid torque change can be prevented. As a result, an excellent image without irregularity can be formed.

Thus, this embodiment is able to prevent rapid torque change and form images stably.

Fifth Embodiment

Figure 15:
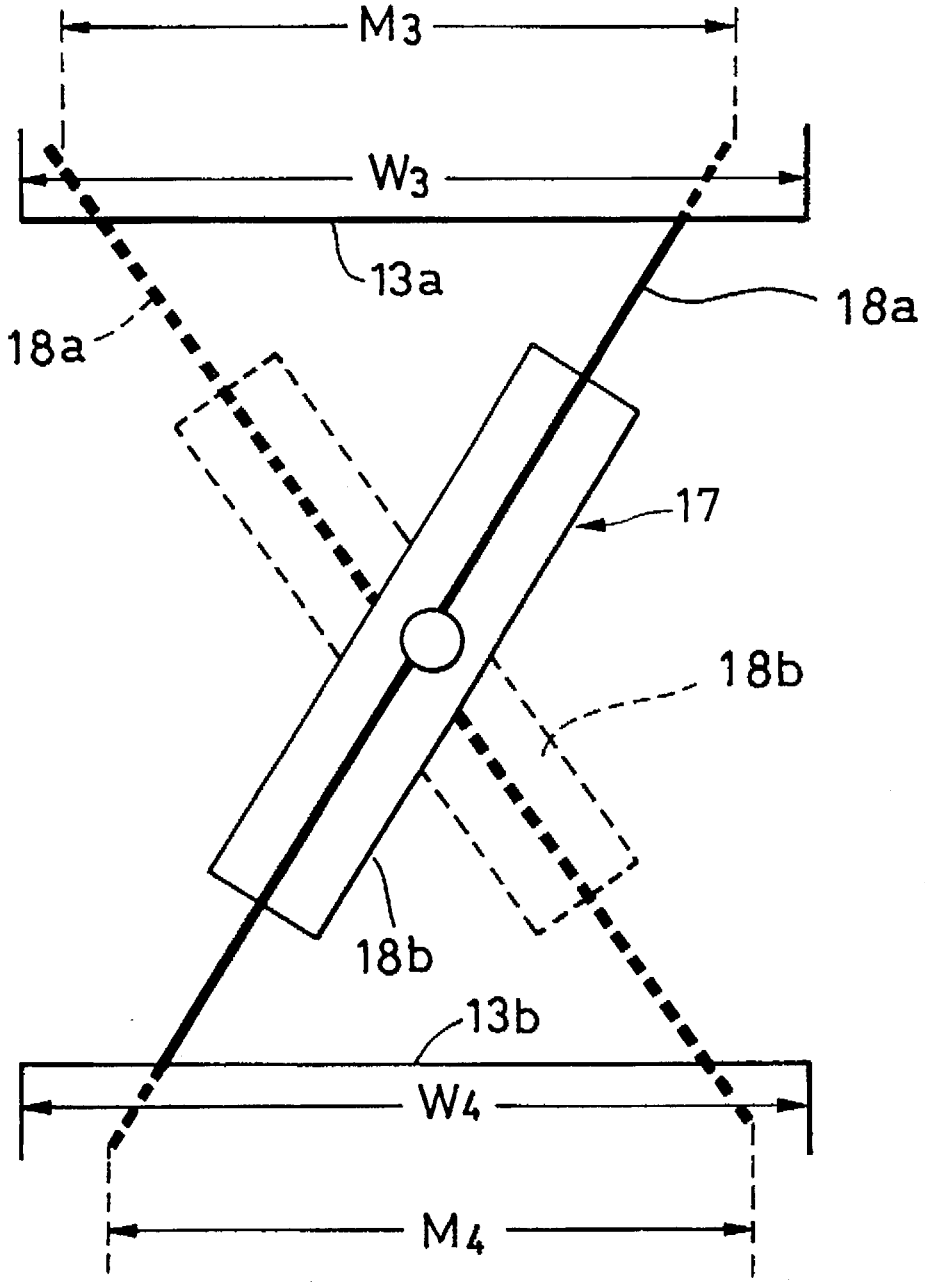
FIG. 15 is a cross sectional view which illustrates the positional relationship between the wiping member and the transparent windows according to a fifth embodiment of the present invention.

A fifth embodiment of the present invention will now be described with reference to FIG. 15. This embodiment is different from the first to fourth embodiments with respect to the positional relationship between the wiping member and the transparent windows. The other structures are the same as those of the first embodiment and therefore the descriptions of the same elements are omitted.

As described above in the fourth embodiment, the rapid torque change generates image irregularity. The rapid torque change is generated when the flexible sheet member 18*a* is introduced into the transparent windows 13*a* and 13*b*.

Accordingly, this embodiment is structured such that the widths $W_3$ and $W_4$ of the transparent windows 13*a* and 13*b*, in the direction in which the wiping member 17 is moved, are made to be wider than the maximum amplitudes $M_3$ and $M_4$ of the leading portion of the flexible sheet member 18*a*, that is, the relationships $M_3 \leqq W_3$ and $M_4 \leqq W_4$ are held, for example, $M_3=M_4=15$ mm and $W_3=W_4=20$ mm. As a result, the flexible sheet member 18*a* is always in contact with the transparent windows 13*a* and 13*b*. Thus, a load always acts on the wiping member 17 and the introduction of the flexible sheet member 18*a* into the transparent windows 13*a* and 13*b* is prevented. Therefore, rapid torque change can be prevented, leading to a fact that excellent images free from irregularity can be formed.

As a result, rapid torque change can be prevented and images can be stably formed.

Sixth Embodiment

Figure 16:
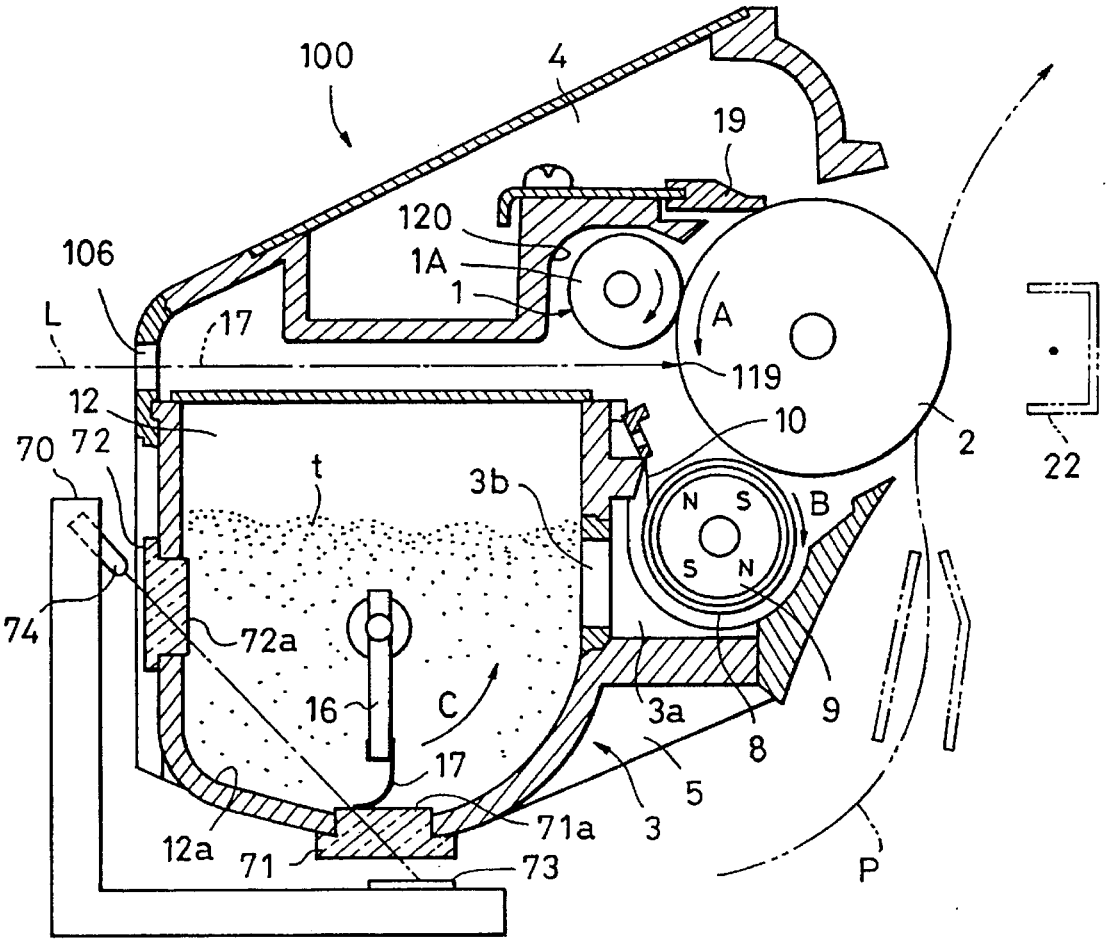
FIG. 16 is a cross sectional view which illustrates the process cartridge according to a sixth embodiment of the present invention.
Figure 17:
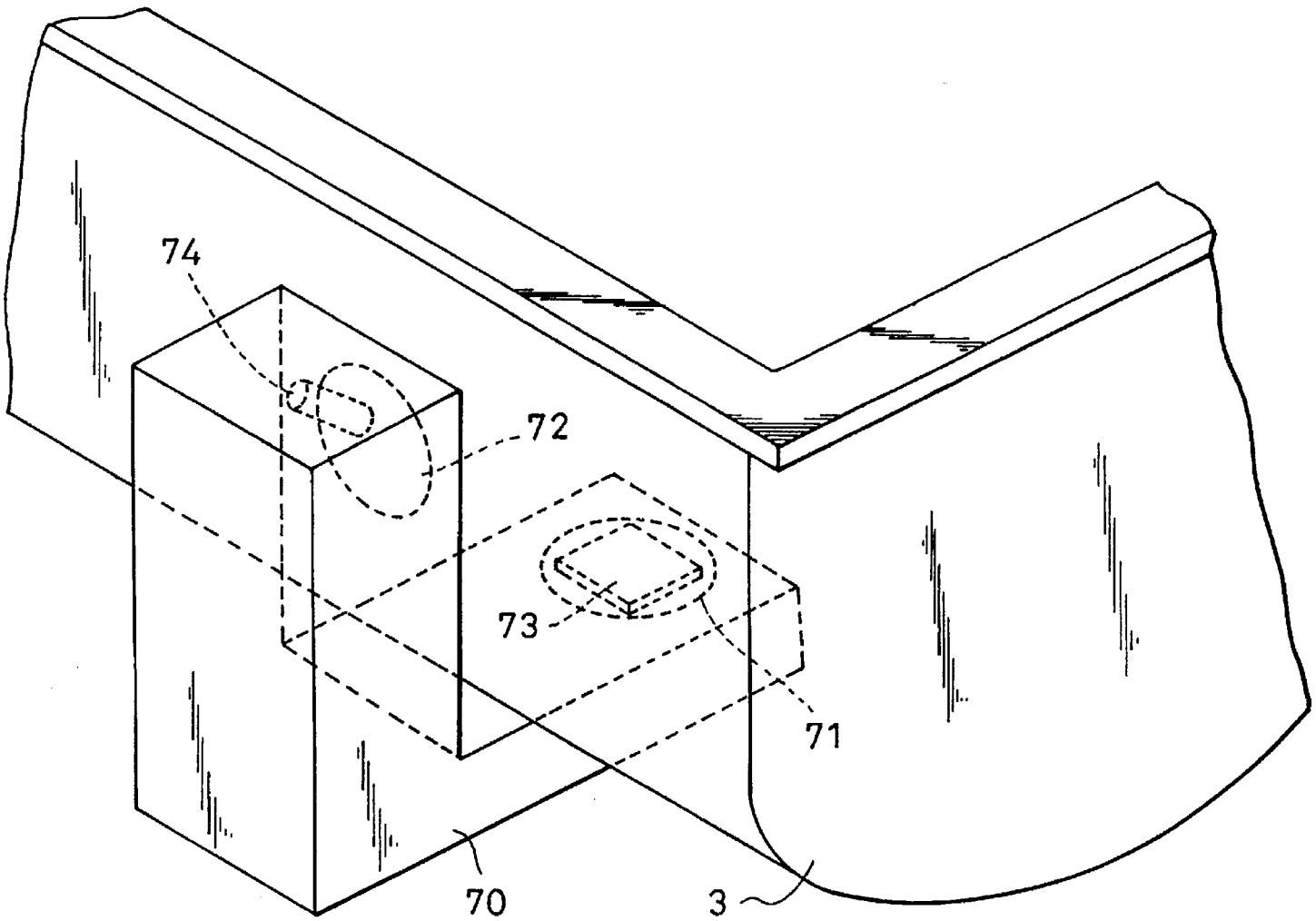
FIG. 17 is a partial perspective view which illustrates the positional relationship among the process cartridge shown in FIG. 16, a light emitting means and a light receiving means that are provided for an image forming apparatus.
Figure 18:
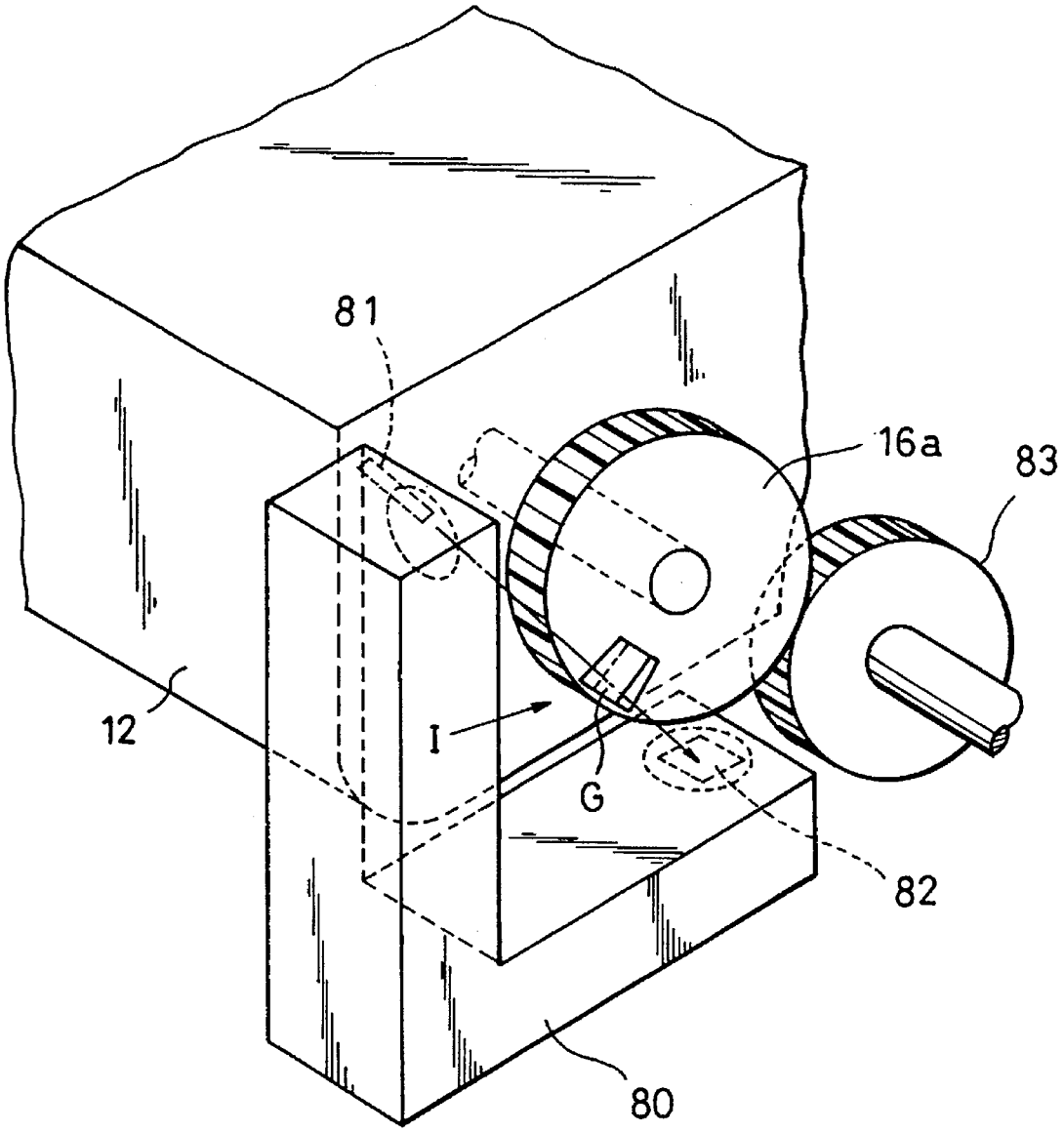
FIG. 18 is a partial perspective view which illustrates a gear for a stirring member provided for the process cartridge shown in FIG. 16.

A sixth embodiment of the present invention will now be described with reference to FIGS. 16 to 19. FIG. 16 is a vertical cross sectional view of a process cartridge having a developing unit according to the present invention. FIGS. 17 and 18 are partial perspective views of the process cartridge.

The process cartridge 100 is made to be detachable with respect to the image forming apparatus body. In the right portion of the housing 5 of the process cartridge 100, the photosensitive drum 2 serving as the latent image carrier is rotatively disposed. The photosensitive drum 2 has an image exposing portion 119 which is irradiated with exposing light (slit exposing light or laser scan exposing beam) L supplied from the image forming apparatus body through a slit-shape exposing window 106 formed in the left portion of the housing 5 when viewed in FIG. 16. A transfer charger 22 is disposed on the image forming apparatus body at a position opposing the right portion of the photosensitive drum 2 shown in FIG. 16.

In the housing 5, the charging unit 1, the developing unit 3 and the cleaning unit 4 are disposed in such a manner that the charging unit 1 and the cleaning unit 4 are, with respect to the exposing portion 119, disposed upstream from the photosensitive drum 2 in the direction designated by the arrow A shown in FIG. 16 and the developing unit 3 is disposed downstream. The charging unit 1 includes a charging roller 1A that is rotated while being in contact with the photosensitive drum 2. The charging roller 1A is accommodated in a recess 120 of the cleaning unit 4. The charging unit 1 may be a corona charging unit. The cleaning unit 4 includes a cleaning blade 19 made of urethane rubber or the like. The cleaning blade 19 is in contact with the top surface of the upstream portion of the photosensitive drum 2 in the rotational direction.

The developing unit 3 comprises a developing machine 3*a* which accommodates a developing roller 8 and a developer container 12 disposed on the left of the developing machine 3*a*. The developing machine 3*a* and the developer container 12 are communicated with each other through a communication hole 3*b* formed in a partition wall between the two units. The developer container 12, accommodating developer t which is a mono-component magnetic developer, includes the stirring plate 16 serving as a means for stirring the developer and a wiping member 17 attached to the leading portion of the stirring plate 16 and serving as a conveying member. The stirring plate 16 is rotated in the direction designated by the arrow C at a predetermined speed. The developing roller 8 is rotated in the direction designated by the arrow B and includes a magnet 9. The surface of developing roller 8 has adequate projections and pits for satisfactorily conveying the developer t. A developing blade 10 made of an elastic material such as urethane rubber, silicon rubber or a SUS thin plate is brought into contact with the surface of the developing roller 8.

In the foregoing apparatus according to this embodiment, the photosensitive drum 2 is uniformly charged with positive or negative electricity by the charging roller 1A. Then, the photosensitive drum 2 is irradiated with exposing light L in its exposing portion 119 so that a latent image is formed. The portion of the photosensitive drum 2 on which the latent image has been formed is moved to a portion opposing the developing roller 8, that is, the developing portion, when the photosensitive drum 2 is rotated in the direction designated by the arrow A. On the other hand, the developer t in the developer container 12 is stirred when the stirring plate 16 serving as the means for stirring the developer is rotated at a predetermined speed. Furthermore, a portion of the developer t is, by the wiping member 17 serving as the conveying member attached to the leading portion of the stirring plate 16, intermittently introduced and supplied into the developing machine 3*a* through the communication hole 3*b* whenever the stirring plate 16 is rotated. The developer t is supplied to the surface of the developing roller 8 due to the effect of the magnet 9, and is moved so as to be pressurized by the developing blade 10 when the developing roller 8 is rotated in the direction designated by the arrow B. Thus, the developer t is given adequate triboelectricity (electricity charged frictionally) and is formed into a thin layer on the developing roller 8. In the developing portion, the latent image on the photosensitive drum 2 is developed as an image of the developer when the developing roller 8 is applied with a predetermined voltage (a developing bias). The developer image is, in the image transferring portion between the transfer charger 22 and the photosensitive drum 2, sequentially transferred to the surface of a transfer member P supplied from a paper feeding mechanism (not shown) in the image forming apparatus body. Then, the transfer member P, separated from the surface of the photosensitive drum 2, is moved to a fixing unit (not shown) so that the developer image on the transfer member P is fixed. Thus, the image forming operation is completed and the transfer member P is discharged to the outside of the apparatus. On the other hand, the developer and other adhered materials left on the surface of the photosensitive drum 2 are wiped and removed by the cleaning blade 19 of the cleaning unit 4 so as to be cleaned. Thus, the photosensitive drum 2 can be used to form images repeatedly.

The number of times the process cartridge 100 forms images depends upon the quantity of the developer t in the developer container 12. If the quantity of the developer t is smaller than a predetermined quantity, an excellent image cannot be formed. Therefore, the process cartridge 100 must be changed. In the present invention, a means for detecting the quantity of the residual developer is provided to detect the time at which the process cartridge must be changed.

The means for detecting the quantity of the residual developer according to this embodiment will now be described. The developer container 12 has, on the side and bottom surfaces thereof, transparent windows 72 and 71 respectively fitted therein. The transparent windows 71 and 72 are disposed at the same distance from the center of rotation of the stirring plate 16. The inner surfaces 71*a* and 72*a* of the transparent windows 71 and 72 are on the same level as an inner surface 12*a* of the developer container 12 or are made to project inwards. An L-shape sensor frame 70 is provided for the image forming apparatus body to be positioned on the sides of the developing unit 3 outside the process cartridge 100 to outwardly cover the transparent windows 71 and 72. As shown in FIG. 17, the sensor frame 70 has a light emitting portion 74 and a light receiving portion 73 disposed on the two sides of the transparent windows 71 and 72, respectively. The light emitting portion 74 is a lamp, a light emitting diode or the like, while the light receiving portion 73 is a photoelectric cell or the like that converts light into an electric current.

The developer t in the developer container 3*c* is supplied to the developing machine 3*a* to form an image when the stirring plate 16 is rotated. The quantity of the developer t in the developer container 12 is gradually reduced as the developer t is consumed. Such reduction leads to a fact that the quantity of light emitted by the light emitting portion 74, passing through the transparent windows 71 and 72 and reaching the light receiving portion 73 increases. Thus, the light receiving portion 73 generates a voltage that corresponds to the quantity of light. Therefore, detection of the voltage level enables the residual quantity of the developer t in the developer container 12 to be detected.

In order to accurately detect the residual quantity of the developer t by the light transmissive detection means, the surfaces of the transparent windows 71 and 72 must be cleaned satisfactorily. Therefore, the wiping member 17 is structured in such a manner that a flexible sheet, such as a urethane sheet or a polyethylene terephthalate (PET) sheet, slides on the surfaces of the transparent windows 71 and 72. Thus, the developer t can be removed from the surfaces of the transparent windows 71 and 72. In this embodiment, a 50 μm-thick PET sheet is employed.

A gear 16*a* connected to the rotational shaft of the stirring plate 16 is, as shown in FIG. 18, disposed on the outside of the developer container 12 and has a position aligning projection G. The gear 16*a* is engaged to a drive gear 83 of the image forming apparatus body when the process cartridge 100 is loaded into the image forming apparatus body. Furthermore, a sensor 80 for detecting the position of the projection G is provided for the apparatus according to this embodiment. The sensor 80 has a similar structure to that of the means for detecting the quantity of the residual developer and comprises a light emitting portion 81 and a light receiving portion 82.

Figure 19:
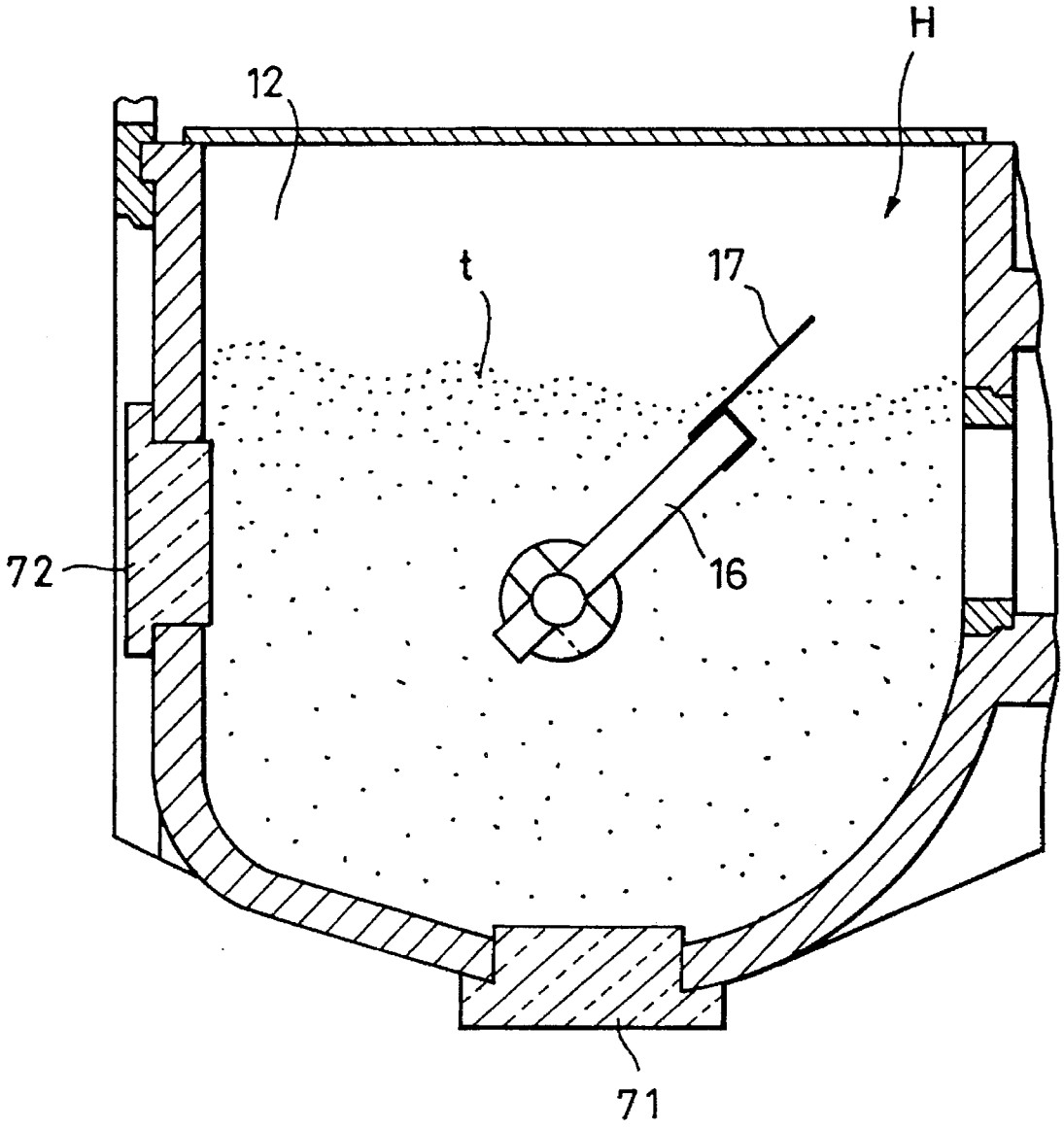
FIG. 19 is a cross sectional view which illustrates the inner portion of the developer container of the process cartridge shown in FIG. 16.

The position of the wiping member 17, that is, the position of the projection G according to this embodiment will now be described. In a state where the process cartridge 100 is not loaded into the image forming apparatus body (that is, in a state where the apparatus is delivered from the manufacturing plant), the wiping member 17 is, as shown in FIG. 19, positioned at position H so as to be in non-contact with the inner wall of the developer container 12 and the transparent windows 71 and 72 by adjusting the position of the projection G. After the process cartridge 100 has been loaded into the image forming apparatus body, the gear 16*a* is rotated by the drive gear 83 during the image forming operation. Thus, the stirring plate 16 and the wiping member 17 are rotated so that the developer t is removed from the surfaces of the transparent windows 71 and 72. Even after the image forming operation has been completed, the rotation of the drive gear 83 is continued. When the projection G is brought to position I (as shown in FIG. 18) (that is, the wiping member 17 is brought to position H, as shown in FIG. 19) and blocks the light passage between the light emitting portion 81 and the light receiving portion 82 in the sensor 80, the rotation of the drive gear 83 is stopped.

As a result of the structure above, the wiping member 17 is in non-contact with the inner wall of the developer container 12 and the transparent windows 71 and 72 except in the period wherein the image is being formed (the state where the process cartridge 100 is not used being included). Therefore, leaving of the wiping member 17 while being deformed for a long time can be prevented. As a result, permanent deformation of the wiping member 17 can be prevented; the contact pressure of the wiping member 17 with the surfaces of the transparent windows 71 and 72 can be stabilized; excellent cleaning performance can be maintained; and the detection of the residual quantity of the developer can precisely be performed for a long time.

Seventh Embodiment

A seventh embodiment of the present invention will now be described with reference to FIGS. 20 and 21. The apparatus according to this embodiment is structured in such a manner that a bearing portion 16*b* for bearing the rotational shaft 16*d* of the stirring plate 16 is, as illustrated, formed into an elongated hole to change the position of the rotational shaft 16*d*. That is, the longitudinal two ends are formed so that the position of the rotational shaft 16*d* is brought to position X before the process cartridge 100 is loaded into the image forming apparatus body (that is, when the apparatus is delivered from the manufacturing plant) and also in a state where the image forming operation is not performed; and the same is brought to position Y when the image is formed (FIGS. 20 and 21).

The mechanism of this embodiment will now be described. Before the process cartridge 100 is loaded into the image forming apparatus body and in a case where the image forming operation is not performed, the rotational shaft 16*d* of the stirring plate 16 is brought to the position X by the pressure of a spring member 16*c* applied to the rotational shaft 16*d*. When the process cartridge 100 has been loaded into the image forming apparatus body, the rotational shaft 16*d* is held by a holder 84 provided for the apparatus body. The rotational shaft 16*d*, held at the position X in the state where the image forming operation is not performed, is brought to the position Y when the image forming operation is performed by an operation of a solenoid 85 provided for the apparatus body to pull the holder 84.

Figure 20:
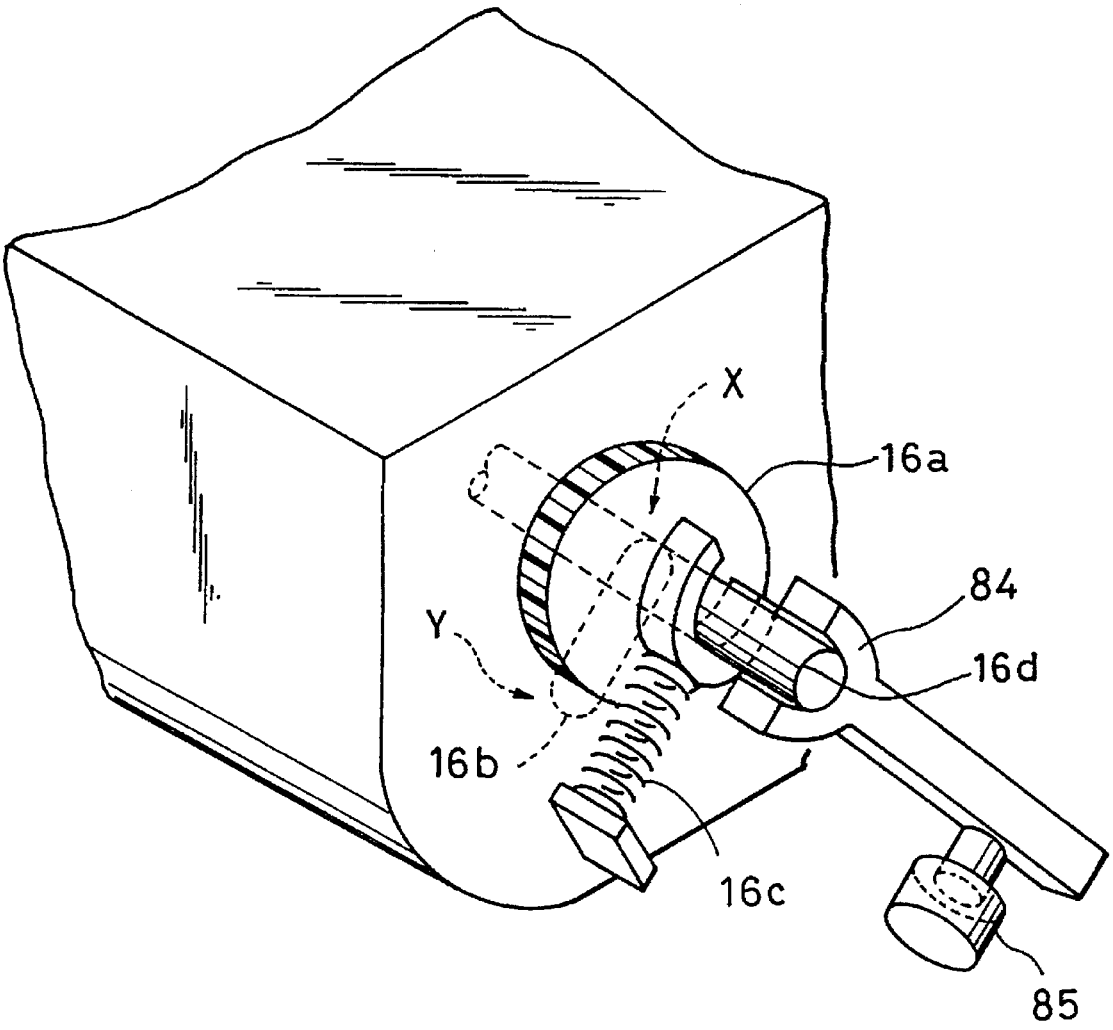
FIG. 20 is a partial perspective view which illustrates the state of the position of a rotational shaft of the stirring member according to a seventh embodiment of the present invention.
Figure 21:
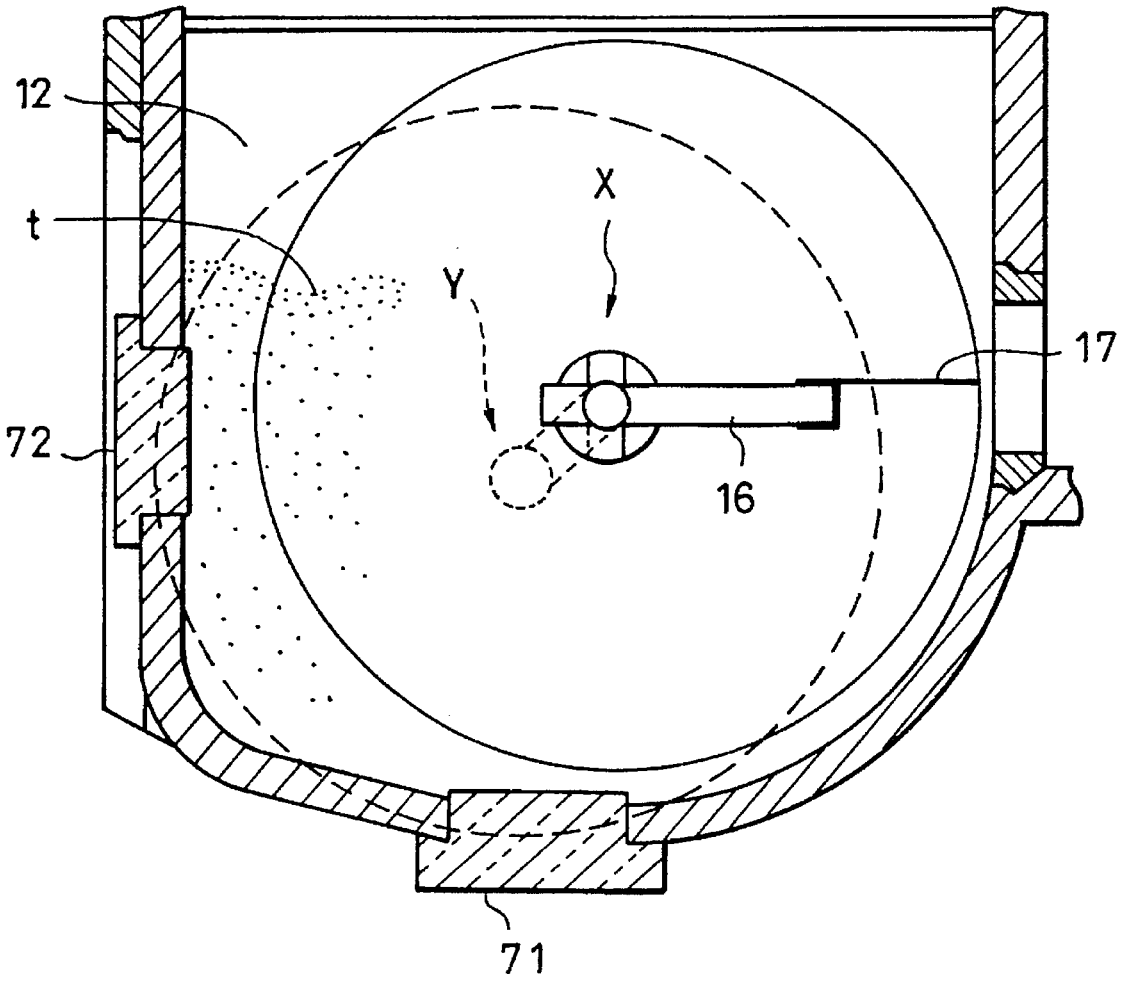
FIG. 21 is a cross sectional view which illustrates the inner portion of the developer container according to the seventh embodiment of the present invention.

In a case where the rotational shaft 16*d* is positioned at X shown in FIG. 20, the wiping member 17 attached to the leading portion of the stirring plate 16 does not come in contact with the inner wall of the developer container 12 and the transparent windows 71 and 72 regardless of the position of the stirring plate 16. In a case where the rotational shaft 16*d* is positioned at Y, the gear 16*a* and a drive gear (not shown) of the apparatus body are engaged to each other so that the stirring plate 16 and the wiping member 17 are rotated. The radius of the rotation of the stirring plate 16, the length of the wiping member 17, and the positional relationship between the transparent windows 71 and 72 are determined so that the leading portion of the wiping member 17 assuredly slides on the surfaces of the transparent windows 71 and 72.

As a result of the foregoing structure, the wiping member 17 is in non-contact with the inner wall of the developer container 12 and the transparent windows 71 and 72 in states other than the image forming period (a state in which the process cartridge 100 is not used being included). Therefore, leaving of the wiping member 17 while being deformed for a long time can be prevented. This embodiment has an effect that the structure can be simplified as compared with the sixth embodiment because the means for detecting the stirring plate 16 and the wiping member 17 can be omitted from the image forming apparatus body.

The present invention is not limited to the foregoing embodiments and may be varied within the scope of the present invention.

Eighth Embodiment

An eighth embodiment of the present invention will now be described with reference to FIGS. 22A to 24. This embodiment is different from the sixth embodiment with respect to the shape of the transparent windows. The other structures are the same as those of the sixth embodiment and the descriptions of the same elements are omitted.

Figure 22A:
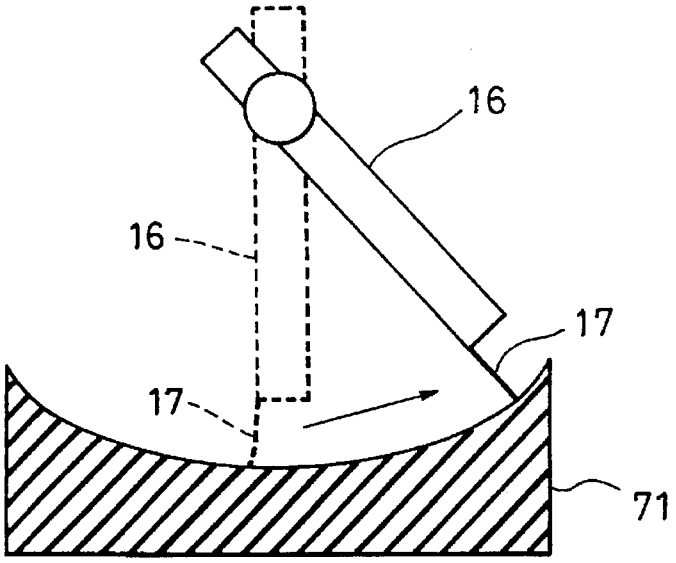
FIG. 22A is a cross sectional view which illustrates the positional relationship between the wiping member and the transparent windows according to an eighth embodiment of the present invention.
Figure 22B:
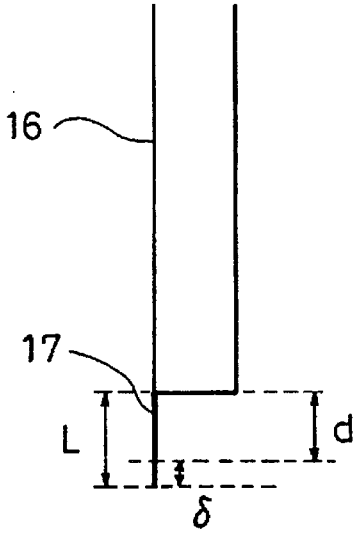
FIG. 22B is an enlarged cross sectional view which illustrates the stirring member and the wiping member according to the eighth embodiment of the present invention.
Figure 23A:
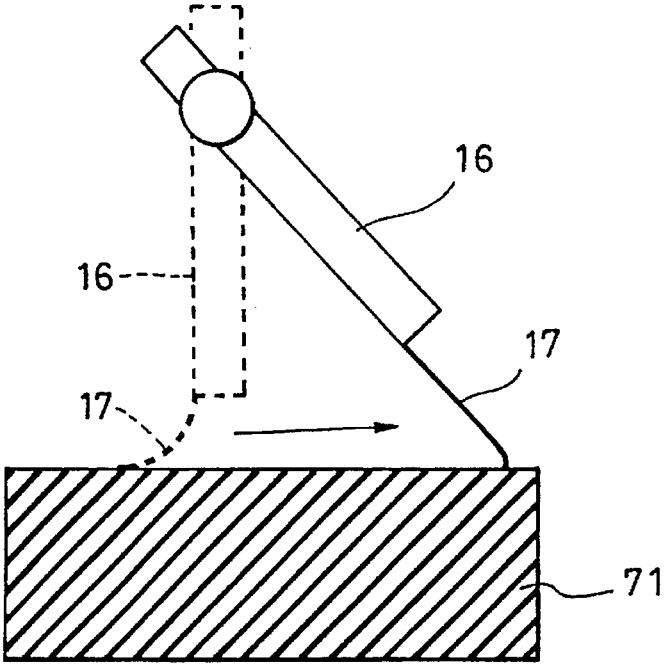
FIG. 23A is a cross sectional view which illustrates the positional relationship between the wiping member and the transparent windows according to a comparative example of the eighth embodiment of the present invention.
Figure 23B:
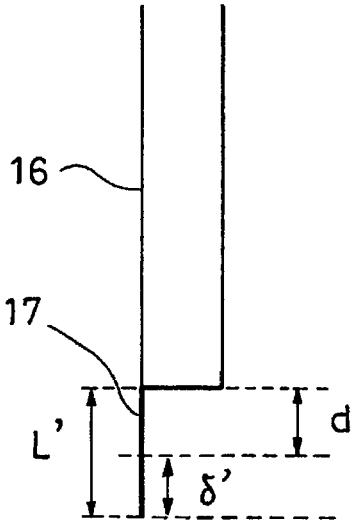
FIG. 23B is an enlarged cross sectional view which illustrates the stirring member and the wiping member according to the comparative example of the eighth embodiment of the present invention.

In this embodiment as shown in FIG. 22A, the shape of each of the transparent windows 71 and 72 facing the interior of developer container is formed into a rounded shape along the locus of the rotation of the wiping member 17, i.e. a curved surface having a curvature center that coincides with the center of the operation of the stirring member 16. When the wiping member 17 is rotated to clean the transparent windows 71 and 72, the introduction quantity 6 of the wiping member 17 is always constant regardless of the position of the wiping member 17 that is in contact with the transparent windows 71 and 72. The introduction quantity $\delta$ is made such that the relationship $\delta=L-d$ is held assuming that the free length of the wiping member 17 is L and the distance from the supporting point of the wiping member 17 and the transparent windows 71 and 72 is d (as shown in FIG. 22B).

Figure 24:
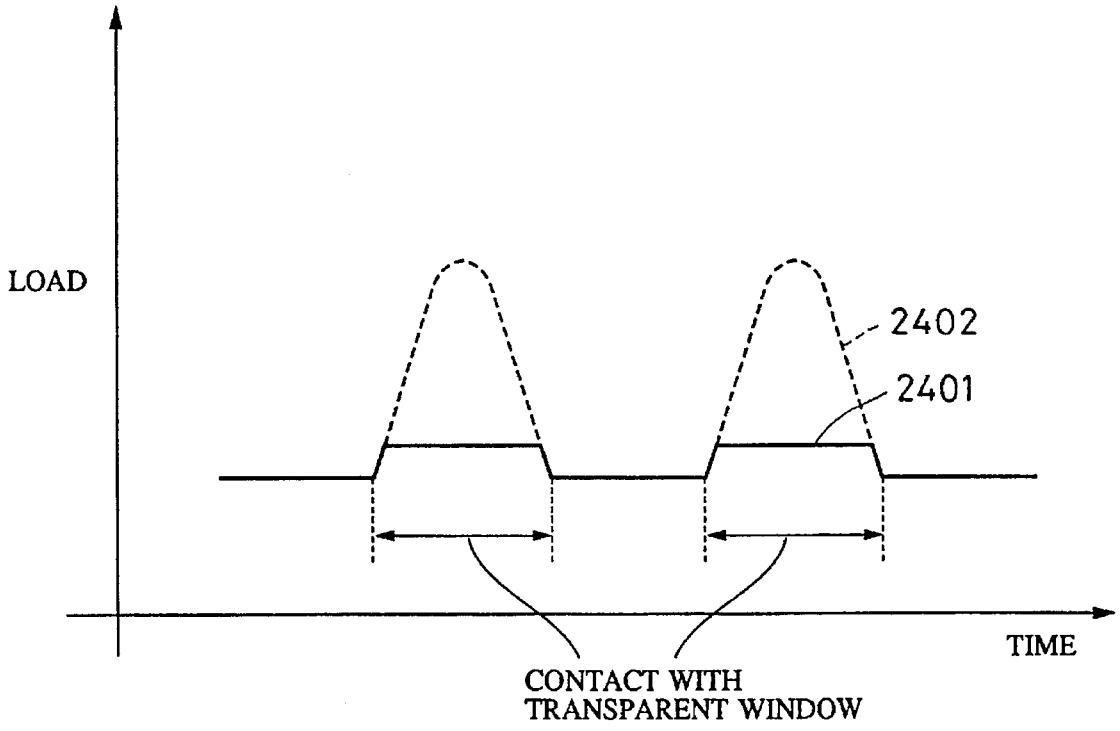
FIG. 24 is a graph showing a state of load of the wiping member according to the eighth embodiment of the present invention.

Change in the load acting on the wiping member 17 when the wiping member 17 is operated is shown in FIG. 24. As can be understood from FIG. 24, the torque can be reduced and stabilized (solid line 2401) as compared with the conventional structure (dotted line 2402). Since this embodiment is able to shorten the free length L of the wiping member 17 as compared with the free length L' of the conventional structure shown in FIGS. 23A and 23B, the torque can be reduced. Furthermore, the introduction quantity $\delta$ can be decreased as compared with the quantity $\delta'$ of the conventional structure. The necessity of considerably bending the wiping member 17 can be eliminated and the torque change can be minimized and stabilized.

As can be understood from the foregoing figures, the areas of the transparent windows 71 and 72 can be enlarged while restricting the free length of the wiping member 17. Therefore, the quantity of the residual developer can be stably detected.

Since the excessive contact of the wiping member 17 with the transparent windows 71 and 72 can be prevented, the adhesion of the molten developer, damage and the like occurring as the apparatus is used can be prevented. Therefore, the detecting accuracy can be improved.

This embodiment may be adapted to an apparatus for detecting a developer, the apparatus being of a type wherein the apparatus performs a reciprocating operation to clean the transparent windows.

Ninth Embodiment

A ninth embodiment of the present invention will now be described with reference to FIGS. 25 to 27. This embodiment is characterized by the positions of the wiping member 17 and the transparent windows 71 and 72. The other structures are the same as those of the sixth embodiment and therefore the descriptions of the same elements are omitted.

Figure 25:
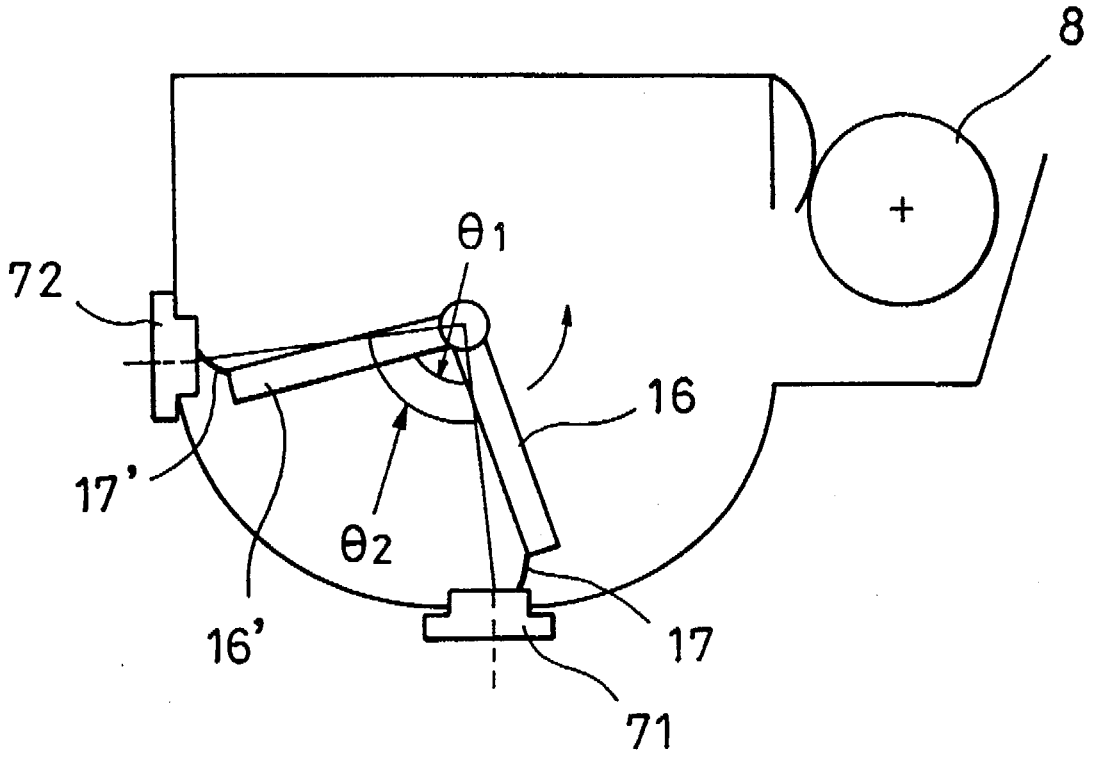
FIG. 25 is a cross sectional view which illustrates the positional relationship between a stirring member and the transparent windows according to a ninth embodiment of the present invention.

FIG. 25 shows an example of structure in which this embodiment is applied to a developing unit of a type having the wiping member 17 that rotates to clean the transparent windows 71 and 72. The foregoing structure is constituted by enlarging the portion including the developer container 12 shown in FIG. 16.

In this example, two wiping members 17 and 17' (connected respectively to stirring members 16 and 16' are provided as shown in FIG. 25 in such a manner that the arm angle $\theta_1$ is made to be the same as the angle $\theta_2$ made by the two transparent windows 71 and 72. Furthermore, the detection of the developer is performed within one second immediately after the two wiping members 17 and 17' have been rotated and caused to wipe the transparent windows 71 and 72, respectively.

Since the detection is performed immediately after the transparent windows 71 and 72 have been cleaned, that is, the detection is performed before the developer, stirred up after either of the transparent windows 71 and 72 has been cleaned, adheres to and contaminates the other window, the detecting accuracy can be improved.

Figure 26:
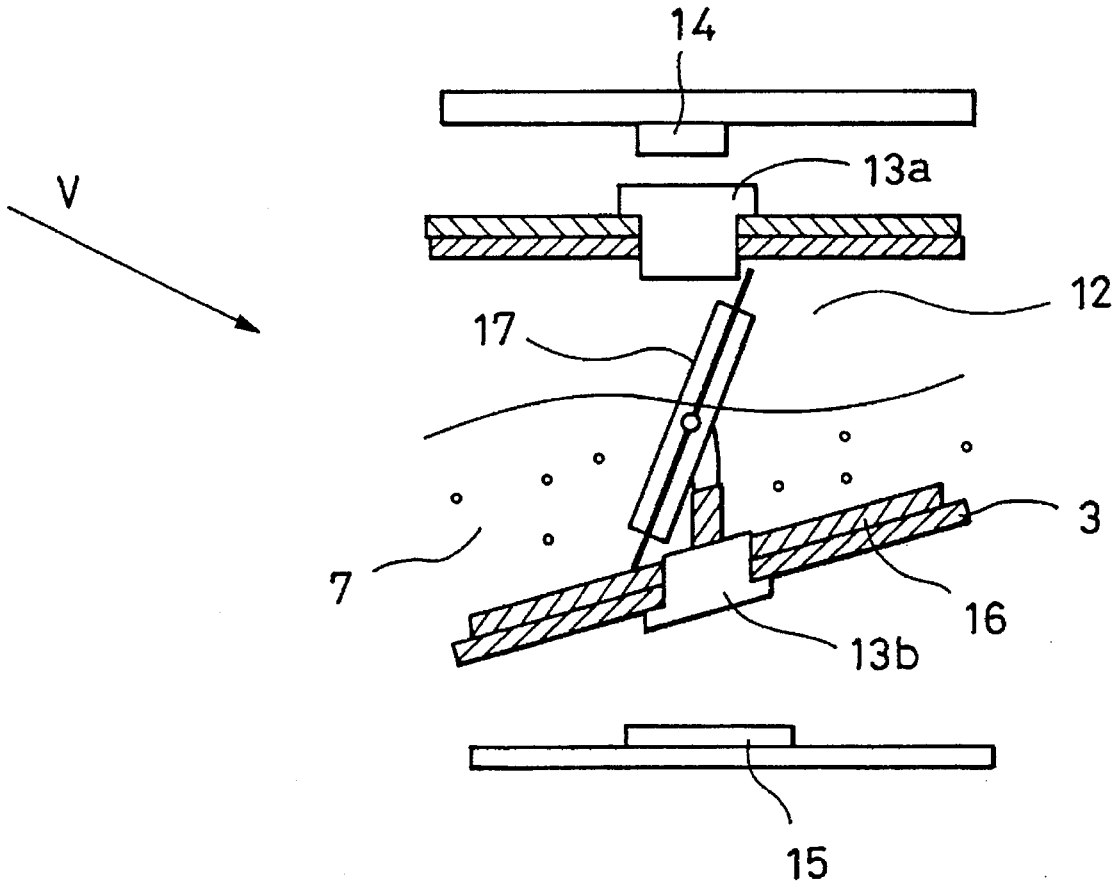
FIG. 26 is a cross sectional view which illustrates the positional relationship between the stirring member and the transparent windows according to the ninth embodiment of the present invention.
Figure 27:
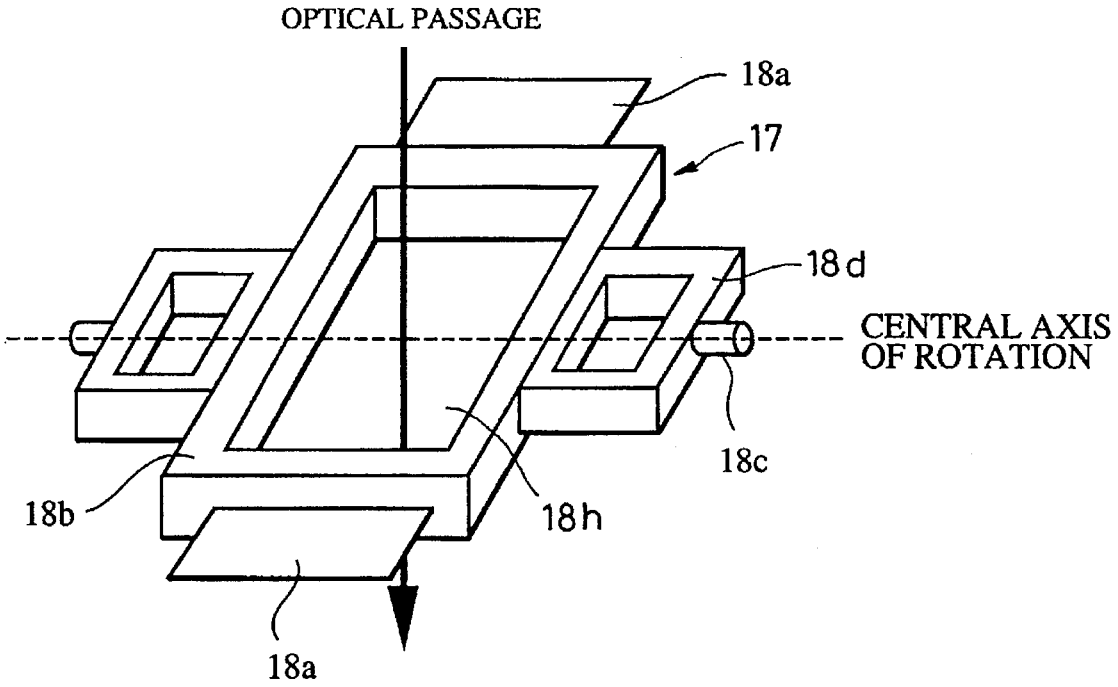
FIG. 27 is a perspective view which illustrates the wiping member shown in FIG. 26.

FIG. 26 shows an example in which this embodiment is applied to a developing unit of a type having a wiping member that performs a reciprocating operation for cleaning the transparent windows. FIG. 27 is a schematic view of the wiping member 17 viewed in a direction designated by an arrow V shown in FIG. 26. In this case, the optical axis is caused to pass through the rotation center of the wiping member 17. As a result, the transparent windows can be cleaned simultaneously and the detection of the quantity of the developer can be performed immediately after the wiping operation has been performed even in an apparatus for detecting the residual quantity of the developer that comprises a reciprocating-type wiping member.

Tenth Embodiment

A tenth embodiment of the present invention will now be described with reference to FIGS. 28 and 29. This embodiment is characterized in the shapes of the wiping member and the transparent windows. The other structures are the same as those shown in FIG. 1 and therefore the descriptions of the same elements are omitted.

Figure 28:
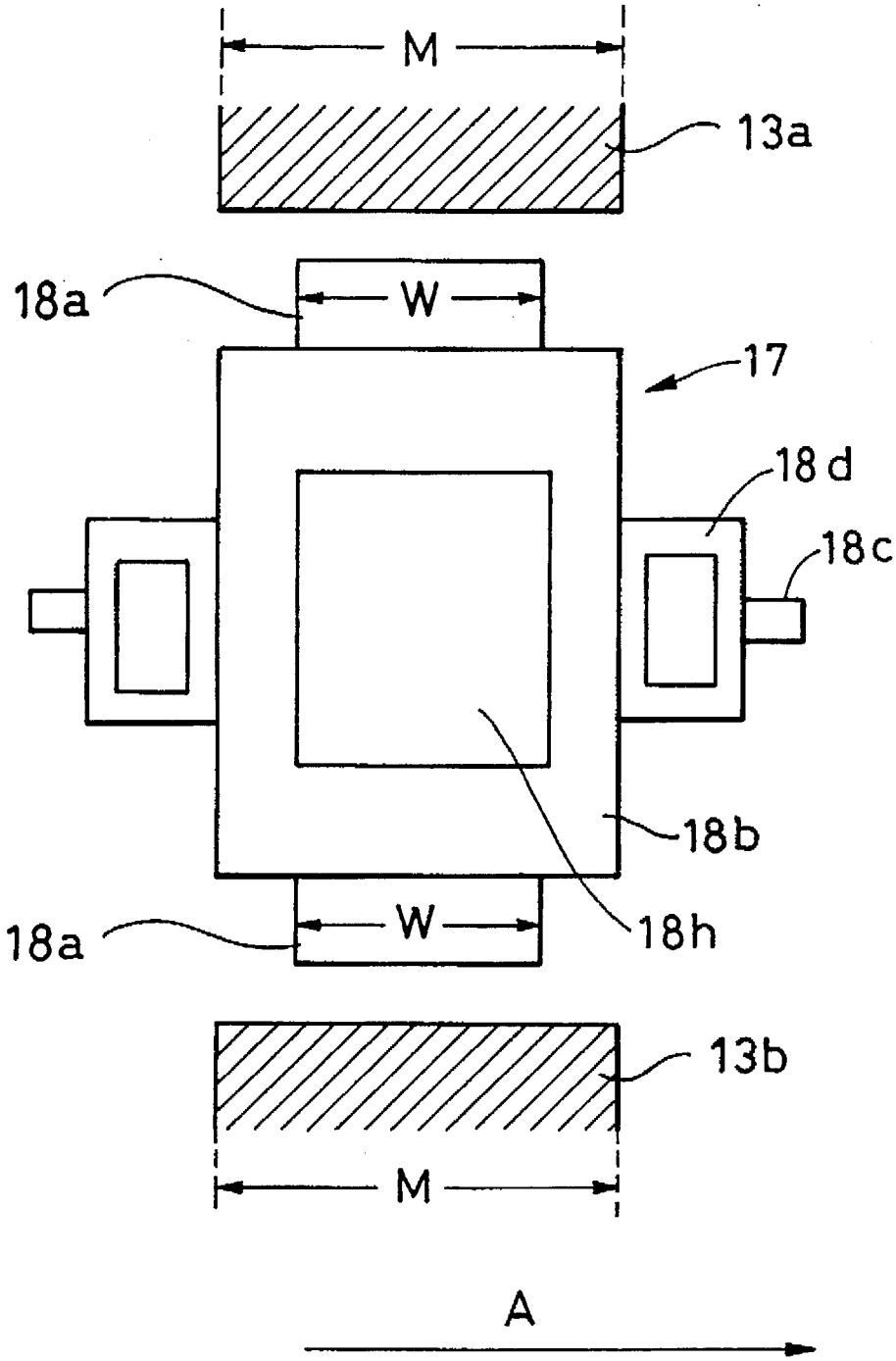
FIG. 28 is a cross sectional view which illustrates the positional relationship between the wiping member and the transparent windows according to a tenth embodiment of the present invention.
Figure 29:
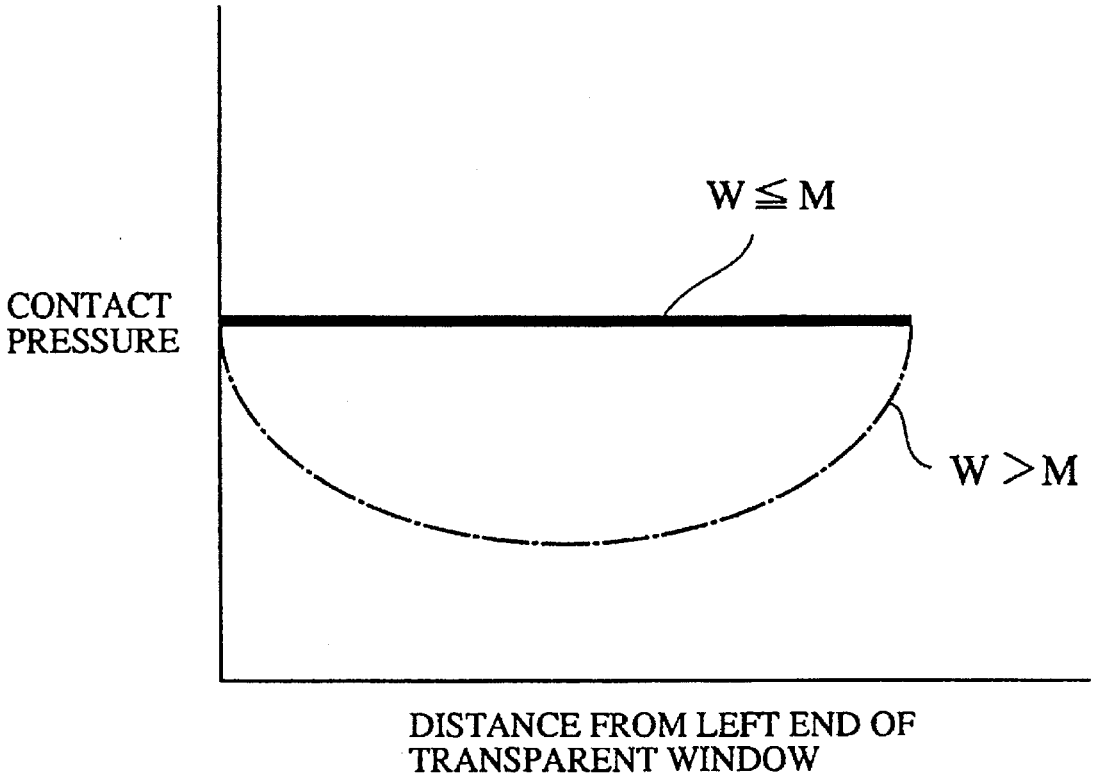
FIG. 29 is a graph showing contact pressure of the wiping member with the transparent windows according to the tenth embodiment of the present invention.

FIG. 28 is a diagram showing the wiping member 17 and the transparent windows 13*a* and 13*b* viewed from the developer carrier 8. As can be understood from FIG. 28, this embodiment is characterized in that the width W of the flexible sheet member 18*a* and the width M of each of the transparent windows 13*a* and 13*b* are caused to have the relationship W≦M. In a contrary case where W>M, the contact pressure of the flexible sheet member 18*a* with the transparent windows 13*a* and 13*b* in a direction designated by an arrow A shown in FIG. 28 is as shown in FIG. 29 (dotted line). That is, the contact pressure to be applied to the central portions of the transparent windows 13*a* and 13*b* is lowered and also the sliding force is weakened. In this case, the developer adhered to the surfaces of the central portions of the transparent windows 13*a* and 13*b* cannot easily be removed. Accordingly, this embodiment has a structure that W≦M, for example, W=7 mm and M=100. Thus, the contact pressure applied to the transparent windows 13*a* and 13*b* in the direction designated by the arrow A can be made to be uniform (solid line in FIG. 29). As a result, also the sliding force is made to be uniform and the developer on the surfaces of the transparent windows 13*a* and 13*b* can be removed satisfactorily. Therefore, a sufficiently high output voltage can be maintained from received light. By shortening the width W of the flexible sheet member 18*a*, the load acting on the wiping member 17 can be reduced.

Eleventh Embodiment

Figure 30:
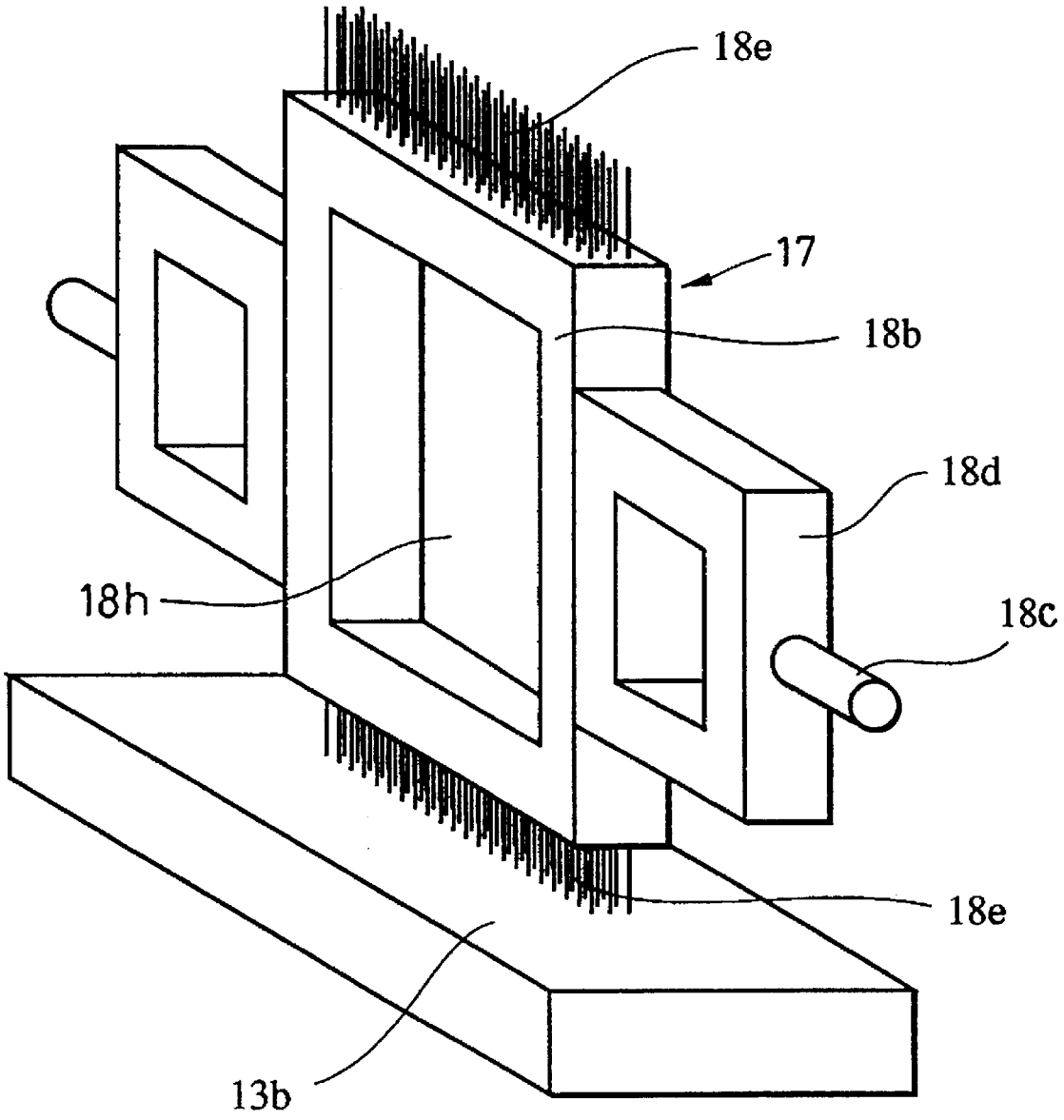
FIG. 30 is a perspective view which illustrates the wiping member and the transparent windows according to an eleventh embodiment of the present invention.

An eleventh embodiment of the present invention will now be described with reference to FIG. 30. This embodiment is characterized by the shapes of the wiping member and the transparent windows. The other structures are the same as those shown in FIG. 1 and therefore the descriptions of the same elements are omitted.

In this embodiment, the surfaces of the transparent windows 13*a* and 13*b* that are in contact with the wiping member 17 are roughened like obscure glass. The wiping member 17 comprises brush-like member 18*e* (for example, pig furs each having a diameter of 50 μm) having a multiplicity of furs, a holding member 18*b* for holding the brush-like member 18*e*, a rotational shaft 18*c* and a swing shaft 18*d*. As a result, the developer 7 on the transparent windows 13*a* and 13*b* can always be made to be uniform in regions in units of several millimeters though the developer is distributed randomly in small regions. Thus, the surfaces of the transparent windows 13*a* and 13*b* can be uniformly cleaned without irregularity. The change in the quantity of transmitted light caused due to the consumption of the developer is as shown in FIG. 3 such that it is stably changed from 0 to a peak value without irregularity though the peak quantity of the transmitted light is reduced from that shown in FIG. 3.

Although the roughness Ra of the surfaces of the transparent windows 13*a* and 13*b* is 0.2 mm at the foregoing time, uniform surfaces can be obtained after they have been cleaned so long as Ra is 0.6 mm or better. Furthermore, a required quantity of light can be obtained.

Although the brush-like member 18*e* is employed to constitute the wiping member 17, a flexible and non-uniform material having a fine surface, such as sponge, may be employed.

Although the surfaces of the two transparent windows 13*a* and 13*b* on the inside of the developer container are roughened, the lower window 13*b* cannot satisfactorily be cleaned because the developer is always left on the surface of the lower window 13*b*. Therefore, if the transmitted light quantity is too small by roughening both of the two windows, instead only the lower transparent window 13*b* may be roughened to obtain a similar cleaning performance. As a result of this embodiment, the residual quantity of the developer 7 can always stably be detected to determine a wanting state of the developer. Thus, the wanting state of the developer can accurately be indicated to a user of an electrophotographic apparatus immediately before the developer runs out.

Although the invention has been described in its preferred form with a certain degree of particularity, it is understood that the present disclosure of the preferred form can be changed in the details of construction and the combination and arrangement of parts may be resorted to without departing from the spirit and the scope of the invention as hereinafter claimed.

What is claimed is:

1. A developing unit comprising:

a developer container for accommodating a developer;

a first window portion which is formed in an upper portion of said developer container and through which light passes;

a second window portion which is formed in a lower portion of said developer container and through which light passes;

a first wiping member for wiping said first window portion;

a second wiping member for wiping said second window portion; and a holding member for holding said first wiping member and said second wiping member at opposite ends of said holding member;

wherein said holding member performs a reciprocating operation with respect to a supporting point and the reciprocating operation is less than 180°.

2. A developing unit according to claim 1, wherein said first wiping member contacts said first window portion with a first contact pressure during wiping of said first window portion, said second wiping member contacts said second window portion with a second contact pressure during wiping of said second window portion, and said second wiping member does not apply a maximum second contact pressure to said second window portion when said first wiping member applies a maximum first contact pressure to said first window portion.

3. A developing unit according to claim 1, wherein said first wiping member contacts said first window portion with a first contact pressure during wiping of said first window portion, said second wiping member contacts said second window portion with a second contact pressure during wiping of said second window portion, and said second wiping member applies to said second window portion a maximum second contact pressure being higher than a maximum first contact pressure applied to said first window portion by said first wiping member.

4. A developing unit according to claim 1, wherein said developing unit is configured to be selectively attachable with respect to an image forming apparatus, the image forming apparatus comprising a light source for emitting light to be introduced into said developer container, and a light receiving member for receiving light transmitted through said window portions of said developer container.

5. A developing unit according to claim 1, further comprising a stirring member for stirring the developer in said developer container, wherein said holding member performs the reciprocating operation in synchronization with said stirring member.

6. A developing unit according to claim 1, wherein said first wiping member has a thickness different from a thickness of said second wiping member.

7. A developing unit according to claim 1, wherein each of said first and second wiping members comprises a brush member.

8. A developing unit according to claim 1, wherein each of said first and second wiping members comprises a flexible sheet member.

9. A developing unit according to claim 1, wherein said holding member comprises (i) a first portion having a first surface facing and disposed apart from said first window by distance $L_1'$, and having a second surface facing and disposed apart from said second window by distance $L_2'$, and (ii) a second portion having a first surface facing and disposed apart from said first window by distance $L_1$, and having a second surface facing and disposed apart from said second window by distance $L_2$, and wherein the following conditions are satisfied:

$L_1>L_1'$, and $L_2>L_2'$.

10. A developing unit adapted for use with an image forming apparatus including an image carrier, said developing unit comprising:

a developer container for accommodating a developer;

a developer carrier facing the image carrier and holding the developer in said developer container;

first and second window portions which are formed in said developer container and through which light can pass;

a first wiping member for wiping said first window portion;

a second wiping member for wiping said second window portion; and a holding member for holding said first wiping member and said second wiping member at opposite ends of said holding member, wherein a distance from a center of operation of said holding member to leading portions of said first and second wiping members is greater than a distance from the center of operation of said holding member to said developer carrier, and said holding member is configured to perform a reciprocating operation which allows said first and second wiping members to reciprocate within a range in which said first and second wiping members are out of contact with said developer carrier.

11. A developing unit according to claim 10, wherein a range of the reciprocating operation performed by said holding member is less than 180°.

12. A developing unit according to claim 10, wherein said first and second window portions and the center of operation of said holding member are disposed substantially on a straight line.

13. A developing unit according to claim 10, wherein said first wiping member contacts said first window portion with a first contact pressure during wiping of said first window portion, said second wiping member contacts said second window portion with a second contact pressure during wiping of said second window portion, and said second wiping member does not apply a maximum second contact pressure to said second window portion when said first wiping member applies a maximum first contact pressure to said first window portion.

14. A developing unit according to claim 10, wherein said developing unit is configured to be selectively attachable with respect to the image forming apparatus, the image forming apparatus further including a light source for emitting light to be introduced into said developer container, and a light receiving member for receiving light transmitted through said window portions of said developer container.

15. A developing unit according to claim 10, further comprising a stirring member for stirring the developer in said developer container, wherein said holding member performs the reciprocating operation in synchronization with said stirring member.

16. A developing unit comprising:

a developer container for accommodating a developer;

a plurality of window portions which are formed in said developer container and through which light passes; and a plurality of wiping members that are moved coincidentally with a developing operation to wipe said window portions, wherein each of said plurality of wiping members is positioned at a position which is out of contact with each of said plurality of window portions during non-developing operations.

17. A developing unit according to claim 16, wherein said developing unit is configured to be selectively attachable with respect to an image forming apparatus, the image forming apparatus comprising a light source for emitting light to be introduced into said developer container, and a light receiving member for receiving light transmitted through said window portions.

18. A developing unit according to claim 16, further comprising means for moving each of said wiping member to be out of contact with said window portion.

* * * * *

UNITED STATES PATENT AND TRADEMARK OFFICE

CERTIFICATE OF CORRECTION

PATENT NO. : 5,649,264

DATED : July 15, 1997

INVENTOR(S) : DOMON ET AL.

It is certified that error appears in the above-identified patent and that said Letters Patent is hereby corrected as shown below:

Column 1

Line 55, "suck" should read --such--.

Column 3

Line 33, "will be" should read --will--.

Column 9

Line 18, "portion or" should read --portion of--.

Column 15

Line 60, "6" should read --δ--.

Column 16

Line 42, "16′" should read --16′)--.

Signed and Sealed this

Seventeenth Day of March, 1998

*Attest:*

*Attesting Officer*

BRUCE LEHMAN

*Commissioner of Patents and Trademarks*